US010801796B2

(12) United States Patent
Kras

(10) Patent No.: US 10,801,796 B2
(45) Date of Patent: Oct. 13, 2020

(54) QUICK DISCONNECT MOUNT FOR MUZZLE ATTACHMENTS

(71) Applicant: Sig Sauer, Inc., Newington, NH (US)

(72) Inventor: Krzysztof J. Kras, Fremont, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 16/412,734

(22) Filed: May 15, 2019

(65) Prior Publication Data

US 2019/0353446 A1 Nov. 21, 2019

Related U.S. Application Data

(60) Provisional application No. 62/672,148, filed on May 16, 2018.

(51) Int. Cl.

| | |
|---|---|
| ***F41A 21/32*** | (2006.01) |
| *F41A 21/30* | (2006.01) |
| *F41A 21/34* | (2006.01) |
| *F41A 21/36* | (2006.01) |

(52) U.S. Cl.

CPC ..... *F41A 21/325* (2013.01); *F41A 21/30* (2013.01); *F41A 21/34* (2013.01); *F41A 21/36* (2013.01)

(58) Field of Classification Search

CPC ..... F41A 21/325; F41A 21/30; F41A 21/34; F41A 21/36

USPC ..... 42/76.01, 79

See application file for complete search history.

(56) References Cited

U.S. PATENT DOCUMENTS

| | | | | |
|---|---|---|---|---|
| 5,509,345 | A * | 4/1996 | Cyktich | F41A 21/325 42/97 |
| 7,353,740 | B1 * | 4/2008 | Hoffman | F41A 21/26 42/107 |
| 7,677,150 | B2 * | 3/2010 | Dater | F41A 21/325 89/14.05 |
| 8,186,261 | B2 | 5/2012 | McNeill et al. | |
| 8,490,535 | B1 | 7/2013 | Moore et al. | |
| 10,132,588 | B2 * | 11/2018 | Salvador | F41A 21/325 |
| 2010/0313743 | A1 * | 12/2010 | Dueck | F41A 21/26 89/14.05 |
| 2012/0272818 | A1 | 11/2012 | Dueck et al. | |
| 2014/0237881 | A1 * | 8/2014 | Mack | F41A 21/325 42/90 |
| 2017/0261281 | A1 * | 9/2017 | Salvador | F41A 21/325 |
| 2018/0017352 | A1 | 1/2018 | Addis | |
| 2019/0316862 | A1 * | 10/2019 | Orne | F41A 21/30 |

* cited by examiner

*Primary Examiner* — Samir Abdosh

(74) *Attorney, Agent, or Firm* — Finch & Maloney PLLC

(57) ABSTRACT

A mounting assembly for a firearm muzzle attachment includes an attachment mount with a clutch assembly. A muzzle attachment can be secured to the distal end portion of the attachment mount. The attachment mount is configured to removably attach the muzzle attachment to a muzzle adapter installed on the end of a barrel. A clutch assembly on the attachment mount is operable between a locked position and an unlocked position. In the locked position, the clutch assembly frictionally engages the muzzle adapter to inhibit loosening rotation of the muzzle attachment relative to the muzzle adapter. In the unlocked position, the clutch assembly disengages from the muzzle adapter to permit loosening rotation of the attachment mount relative to the muzzle adapter. A method of use and a locking nut are also disclosed.

25 Claims, 24 Drawing Sheets

Section A-A

Section B-B

Section C-C

Section B-B

Section C-C locked unlocked

Section D-D

Section E-E

Section E-E

QUICK DISCONNECT MOUNT FOR MUZZLE ATTACHMENTS

RELATED APPLICATIONS

This application claims the benefit under 35 U.S.C. § 119(e) of U.S. Provisional Patent Application No. 62/672,148 titled QUICK DISCONNECT MOUNT FOR MUZZLE ATTACHMENTS, and filed on May 16, 2018, the contents of which are incorporated herein by reference in their entirety.

FIELD OF THIS DISCLOSURE

This disclosure relates to accessories for use with firearms and more particularly to a mount for muzzle attachments.

BACKGROUND

The design of firearms and related accessories involves many non-trivial challenges. Some accessories are designed to be mounted to the muzzle-end of a firearm barrel in one or more particular rotational orientations to accomplish a desired effect. For example, a muzzle brake is an attachment that redirects a portion of propellant gases away from the bore axis as the gases escape from the barrel. When directed rearwardly, the gases push the firearm forward to partially counteract recoil forces from discharging the firearm. A muzzle brake is typically mounted to a firearm barrel in a particular rotational orientation to prevent gases from being directed upward into the line of sight of the firearm operator, or downward into the dirt or dust.

Suppressors are another muzzle accessory intended to reduce the audible report and the flash signature of the firearm. Suppressors include a series of baffled chambers that slow down the expansion and the release of pressurized gases leaving the barrel, therefore reducing the audible report when discharging the firearm. The central opening through the suppressor must be sufficiently aligned with the bore axis to prevent a projectile from striking the suppressor and to prevent reductions in accuracy. For this reason, the suppressor is generally attached securely to the barrel using a method that provides precision alignment with the bore axis.

SUMMARY

The present disclosure is directed to a mounting assembly for attaching accessories to the muzzle of a firearm, a locking nut assembly, and a method of attaching a muzzle attachment to a firearm using a mounting assembly that inhibits or prevents inadvertent loosening of the attachment. One aspect of the present disclosure is directed to a mounting assembly for firearm muzzle devices. In accordance with some embodiments of the present disclosure, the mounting assembly includes a clutch assembly that prevents loosening rotation of the attachment due to vibration, recoil forces, and the like. In some embodiments, the mounting assembly is a quick-disconnect mount that enables the user to remove and/or install a muzzle attachment without the need for tools.

Numerous configurations and variations will be apparent in light of this disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

BRIEF DESCRIPTION OF THE DRAWINGS

FIG. 1C also illustrates an example of the muzzle end portion of a firearm barrel with which the mounting assembly may be used, in accordance with an embodiment of the present disclosure.

Figure 1A:
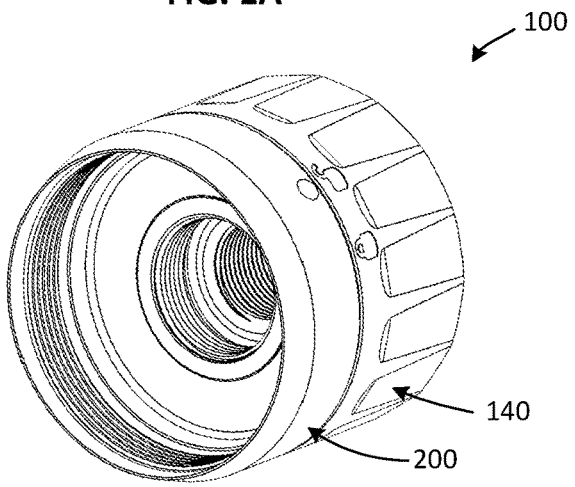
FIG. 1A illustrates a front and side perspective view of a mounting assembly with a clutch collar in an unlocked position, in accordance with an embodiment of the present disclosure.

These and other features of the present embodiments will be better understood by reading the following detailed description, taken together with the Figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

A mounting assembly for firearm muzzle attachments is disclosed. A method of use and a locking nut are also disclosed.

In accordance with some embodiments, the mounting assembly includes an attachment mount with a clutch assembly operable between a locked position and an unlocked position. The attachment mount can be removably attached to a muzzle adapter to attach a muzzle device to the barrel of a firearm. For example, the muzzle adapter can be received in the mount proximal end portion and attached to the attachment mount with threads, a bayonet mount, or other method. The muzzle adapter can be part of the mounting assembly or a separate component, as will be appreciated. The attachment mount has a mount distal end portion configured to be secured to a firearm muzzle device, such as a suppressor, muzzle brake, flash hider, heat shield, or other attachment. In some embodiments, more than one muzzle device may be used together at the same time, such as a muzzle brake and suppressor in combination, or a suppressor in combination with a heat shield, to name a couple examples.

In some embodiments, the mounting assembly includes the muzzle adapter. In one such embodiment, the muzzle adapter has a generally cylindrical body with a threaded portion configured to threadably engage the mount proximal end portion. The muzzle adapter can also include a cylindrical sleeve portion that extends distally of the threaded portion. The muzzle adapter can be attached to the firearm barrel by threaded engagement, a clamping structure, a bayonet mount, or other suitable method, as will be appreciated. The muzzle adapter optionally can include female or male threads, or other structure in the distal end portion for an alternate attachment location for a muzzle brake or other device. In some embodiments, an adapter ring accompanies the muzzle adapter, where the muzzle adapter is received in the adapter ring when installed in the attachment mount. In some embodiments, the muzzle adapter is configured as a muzzle brake or a flash hider, for example.

The clutch assembly has a locking structure disposed between the attachment mount and the muzzle adapter. When the clutch assembly is in the locked position, the locking structure engages the muzzle adapter (or an adapter ring on the muzzle adapter) to prevent or inhibit loosening rotation of the attachment mount relative to the muzzle adapter, in accordance with one example embodiment. In the unlocked position, the clutch assembly disengages the locking structure from the muzzle adapter (or adapter ring) to permit loosening rotation of the attachment mount relative to the muzzle adapter. In some embodiments, the clutch assembly can also occupy a free position, such as when the mounting assembly is disconnected from the muzzle adapter. In the free position, the locking structure can occupy a position that is not attainable when the muzzle adapter is installed in the attachment mount due to physical interference between the locking structure and the muzzle adapter, for example.

In one embodiment, the clutch assembly includes a clutch collar that overlaps the body of the attachment mount and is rotatable about the body between a locked position and an unlocked position. The locking structure includes one or more cams, where each cam is pivotably retained by the body of the attachment mount. Each cam has a cam body with an arcuate cam surface. When the clutch collar is moved to the locked position, the cams pivot to a first position in which the cam surface extends radially inward to a radius equal to or less than the radius of the sleeve portion or other portion of the muzzle adapter. Thus, when the muzzle adapter is installed in the attachment mount, the cam surface frictionally engages the sleeve portion to inhibit rotation of the attachment mount relative to the muzzle adapter. When the clutch collar is moved to the unlocked position, the cams pivot to a second position in which the cam surface extends radially inward to a radius greater than the body radius. Thus, the cam surface is spaced from the sleeve portion and provides clearance for the attachment mount to rotate in a loosening direction. Accordingly, the attachment mount can be rotated relative to the muzzle attachment, such as for unscrewing the attachment mount during removal of the attachment mount from the muzzle adapter.

In accordance with another embodiment of the present disclosure, the clutch assembly is configured as a trapped roller clutch, where the locking structure includes one or more rollers. The attachment mount includes an adapter ring installed on the body portion and configured to prevent rotation between the adapter ring and the muzzle adapter, but to permit axial movement of the muzzle adapter through the adapter ring. For example, the muzzle adapter has a ridge along the sleeve portion that is received in a corresponding slot defined in the inside surface of the adapter ring. Thus, as the attachment mount is screwed onto or unscrewed from the muzzle adapter, the muzzle adapter can travel axially through the adapter ring.

In one embodiment, the adapter ring can be received in the mount proximal end portion and defines a radial gap between the outside surface of the adapter ring and the inside surface of the mount proximal end portion. One or more rollers are disposed in the radial gap between the outside surface of the adapter ring and an inside surface of the mount proximal end portion. In one embodiment, the radial gap defines a clearance region and a pinch region. Rotating the clutch collar to the locked position allows the rollers to move into the pinch region where they are trapped between the adapter ring and the attachment mount, thereby inhibiting loosening rotation of the attachment mount relative to the adapter ring, and therefore relative to the muzzle adapter. Rotating the clutch collar to the unlocked position causes the rollers to move into the clearance region, where the rollers have sufficient space to avoid being trapped, and therefore permitting loosening rotation of the attachment mount.

A locking nut can be used in some embodiments to retain the assembled configuration of the mounting assembly. In one example, the locking nut has an annular body with a distal body portion, a proximal body portion, a radially outer portion, and a radially inward surface defining a female thread. One or more fastener opening is defined through the annular body. A resilient tab is defined in the distal body portion and axially aligned with the fastener opening. For example, the resilient tab has a first tab end portion connected to the radially outer portion of the annular body. The tab extends unattached radially inward to a second tab end that is axially aligned with the radially inward surface. A portion of the female thread extends along the second tab end. When a fastener (e.g., a set screw) is advanced through the fastener opening, the fastener engages the resilient tab and axially deflects the resilient tab, thereby misaligning the portion of the female thread on the distal tab end with the primary portion of the female thread along the radially inward surface of the annular body. The misaligned portions of the female thread results in a frictional force that prevents the locking nut from unscrewing from the attachment mount or other structure to which it is attached. Thus, the resilient tab(s) avoid inadvertent disassembly that may result from vibration or the like.

Various embodiments of the mounting assembly can be used to secure a muzzle attachment to the barrel of a firearm, in accordance with some embodiments of the present disclosure. In one embodiment, A method of securing a muzzle attachment to the barrel of a firearm providing a mounting assembly that includes providing a muzzle adapter, providing an attachment mount with a clutch assembly, installing the muzzle adapter onto a firearm barrel, attaching the attachment mount to the muzzle adapter, and moving the clutch assembly to the locked position, thereby engaging a locking structure between the muzzle adapter and the attachment mount that prevents loosening rotation of the attachment mount relative to the muzzle adapter.

General Overview

As noted above, non-trivial issues arise in the design of firearms and their accessories. For instance, suppressors, muzzle brakes, and other devices can be mounted to the muzzle of a firearm barrel. In some cases, the muzzle attachment can be secured to the barrel by direct threaded engagement with a threaded end of the barrel. In other cases, the muzzle attachment can be secured to the barrel using a mounting assembly or adapter, where the mounting assembly is attached to the barrel (e.g., by threaded engagement) and includes threads or other structure to releasably secure the muzzle attachment to the mounting assembly. For example, a muzzle adapter screws onto a threaded barrel and includes a second coarse thread for securing the muzzle attachment. The attachment can be attached with less than one revolution along the coarse thread, making installation quicker than direct threaded engagement with the barrel. In another example, the mount includes a receptacle that receives part of the muzzle accessory, and secures the accessory in the receptacle in place by tightening a clamp or fasteners that engage the accessory.

One challenge in constructing muzzle attachments and mounts is the need to reliably maintain precise axial alignment between the accessory and the bore axis. For example, a suppressor that becomes misaligned with the bore axis may result in the projectile striking the suppressor baffles, resulting in damage to the suppressor and possible injury to the operator or others nearby.

In addition to precise axial alignment, muzzle attachments ought to resist changes in rotational or longitudinal position due to vibration and recoil forces. For example, a muzzle brake that rotates from its intended position may deflect propellant gases into the operator's optics, into the ground, or in another undesirable direction that interferes with the operator's sight picture or firing accuracy. To prevent movement of the muzzle accessory from recoil forces and the like, one approach has been to design mounts that use threaded engagement with the attachment in addition to having mating surfaces that add a frictional force to secure the attachment. For example, a shallow taper (e.g., 10° or less at each taper surface or ≤20° inclusive) can provide a surface that frictionally engages the accessory as it is threaded onto the mount. The shallow taper forms a seal between the mating surfaces that can effectively prevent unintended loosening of the attachment when tightened sufficiently. However, when tightened enough to prevent loosening from vibration and recoil forces, tools often are necessary to break the seal between the mating surfaces. On the other hand, when the shallow taper is tightened only enough to permit removal by hand, the attachment may vibrate loose and cause accuracy problems, a projectile strike, or the like.

In addition to problems with a sealing taper, many mounting assemblies intended for quick connection and disconnection have proved to be problematic during use in the field. When the barrel and attachment become hot from live fire, for example, thermal expansion can further tighten an already tight interface to the extent that tools are required to remove the accessory. Also, carbon deposits can work into fasteners and into seams between the attachment and the mount, causing the interface to bind. The combination of high heat and carbon deposits has been known to "bake" together assembled parts and require tools to remove the attachment.

An operator may need to remove the muzzle attachment for a variety of reasons, such as to repair or service the attachment, to clear an attachment that has become blocked with mud and vegetation, or to install a different attachment. In the best scenario, the increased effort, time, and/or required use of tools to remove the attachment can be an inconvenience. However, during use in the field, such as during a battle, tools may not be available, time may be critical, and the force needed to remove the attachment may exceed what one can achieve in the field using hands alone.

Therefore, a need exists for an improved mounting assembly for muzzle attachments. In accordance with the present disclosure, some embodiments address this need and others by providing a mounting assembly for firearm muzzle attachments, where the mounting assembly is operable between a locked position, in which the attachment mount is secured to a muzzle adapter, and unlocked position, in which the assembly permits removal of the attachment mount from the muzzle adapter. Some such embodiments facilitate quicker and easier removal of a muzzle attachment compared to existing designs. In accordance with some embodiments, the mounting assembly enables tool-less disconnection of the muzzle attachment from the firearm in a wide variety of operating environments.

The present disclosure also relates to a locking nut that may be used as part of the mounting assembly, in accordance with some embodiments. For example, the locking nut provides a compact axial thickness that is particularly suited for use with a mounting assembly. By utilizing a structure that provides a frictional force in the threads, for example, the locking nut resists coming loose due to vibration and like forces.

In accordance with some embodiments, the disclosed mounting may be detected, for example, by visual inspection of a mounting assembly for firearm muzzle attachments, where the mounting assembly includes features such as a clutch assembly operable between locked and unlocked position. Some embodiments of the disclosed mounting assembly can be detected by visual inspection of a clutch structure with a locking structure comprising cams that engage the outside surface a muzzle adapter or the like. Some embodiments of the disclosed mounting assembly can be detected by visual inspection of a locking structure that includes rollers between an attachment body and an adapter ring configured to receive the muzzle adapter. In another aspect of the present disclosure, a locking nut as disclosed herein can be detected by visual inspection of a locking nut that includes one or more resilient tabs, where the tabs include a part of the thread of the locking nut, and where the tabs can be caused to frictionally engage the corresponding threads on another component to which the locking nut is attached. In yet another aspect, methods of attaching a muzzle device according to the present disclosure can be detected by use of a mounting assembly utilizing a clutch assembly. Some methods can be detected by a mounting assembly providing tool-less disconnection of a muzzle attachment from a firearm barrel.

As used herein, the term "locked" refers to a condition or position of the mounting assembly in which one or more components of the assembly must fail, or in which frictional forces retaining the attachment mount on the muzzle adapter must otherwise be overcome, in order to disconnect the attachment mount from the muzzle adapter. When the clutch assembly is in the locked position, for example, frictional forces of a locking structure prevents or inhibits removal or loosening rotation of the attachment mount from the muzzle adapter, whether inadvertently, intentionally, due to vibration or recoil forces, or due to some other cause, until the clutch assembly is moved to the unlocked position. The term "unlocked" refers to a condition or position of the mounting assembly in which the attachment mount can be readily removed from the muzzle adapter, such as by hand and without the use of additional tools. When the clutch assembly is in the unlocked position, for example, the locking structure does not prevent or inhibit loosening rotation of the attachment mount relative to the muzzle adapter.

While generally referred to herein as a 'mounting assembly' for consistency and ease of understanding the present disclosure, the disclosed mounting assembly is not limited to that specific terminology and alternatively can be referred to, for example, as a mount, a muzzle adapter, or other terms. As will be further appreciated, the particular configuration (e.g., materials, dimensions, etc.) of a mounting assembly configured as described herein may be varied, for example, depending on whether the intended use is military, tactical, or civilian in nature. Numerous configurations will be apparent in light of this disclosure.

Structure and Operation

Figure 1B:
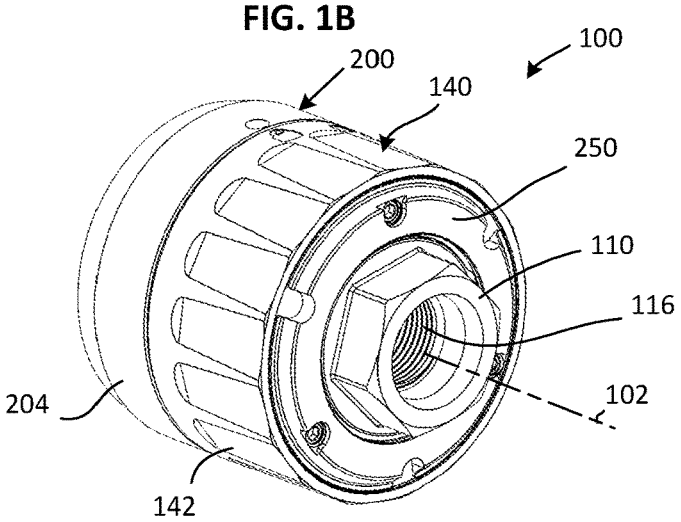
FIG. 1B illustrates a rear and side perspective view of the mounting assembly of FIG. 1 with the clutch collar in the locked position, in accordance with an embodiment of the present disclosure.
Figure 1C:
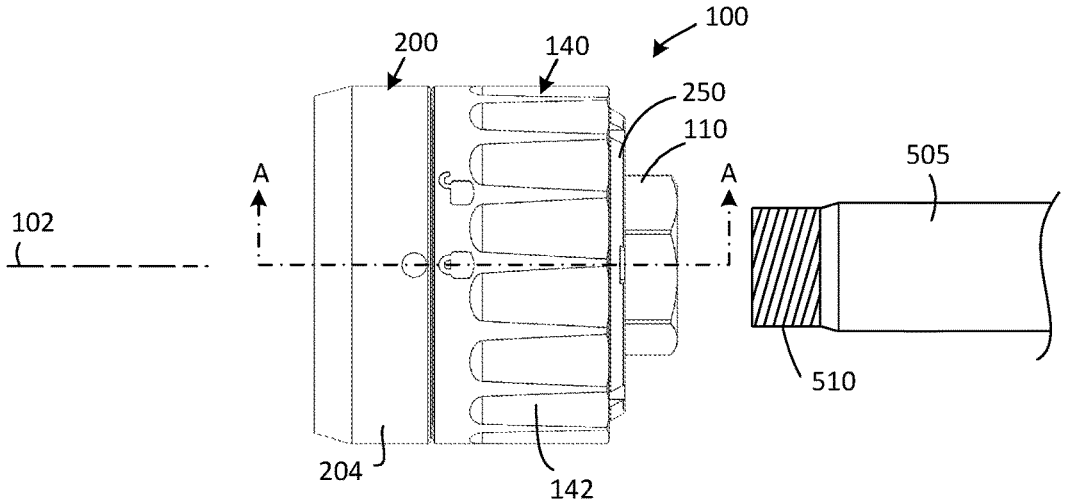
FIG. 1C illustrates a top plan view of the mounting assembly of FIG. 1 with the clutch collar in the locked position, in accordance with an embodiment of the present disclosure.
Figure 1D:
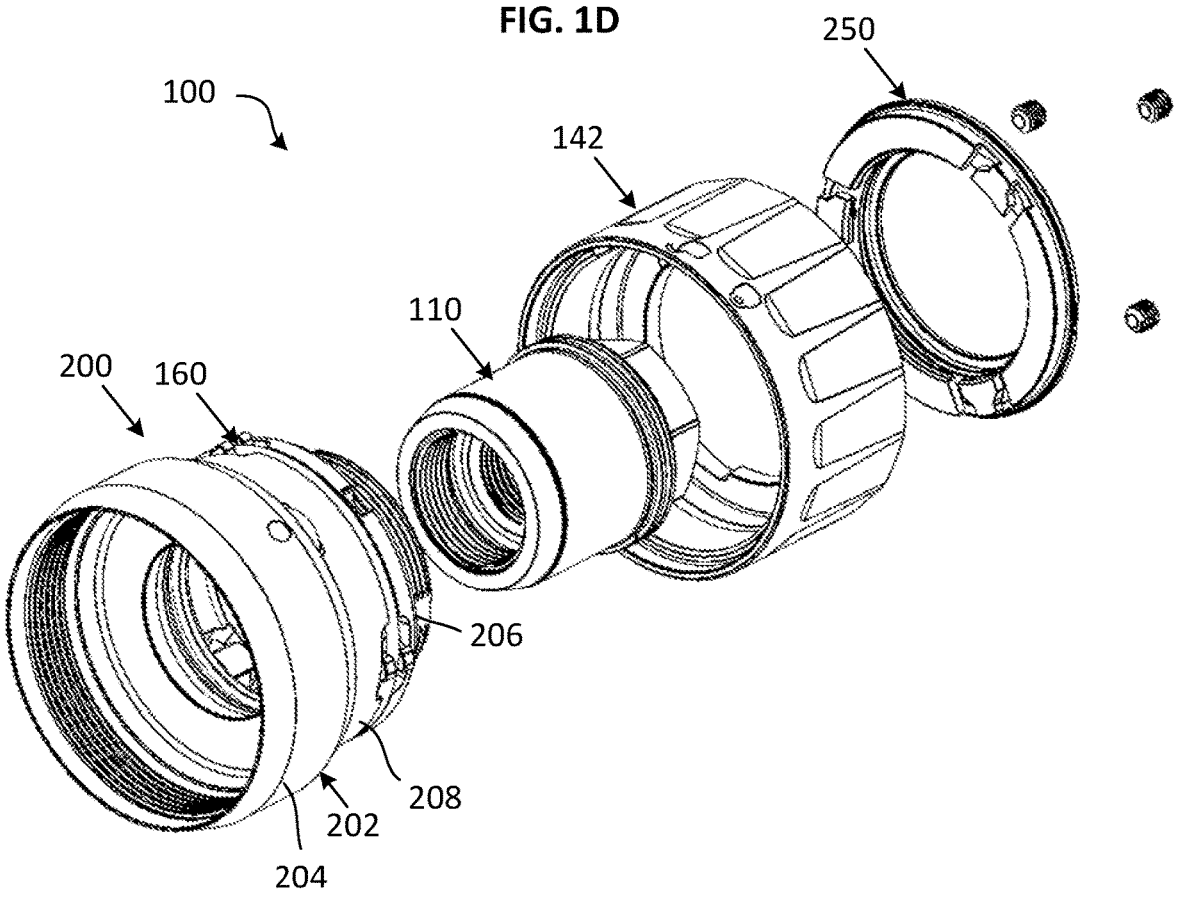
FIG. 1D illustrates an exploded, front and side perspective view of a mounting assembly, in accordance with an embodiment of the present disclosure.
Figure 1E:
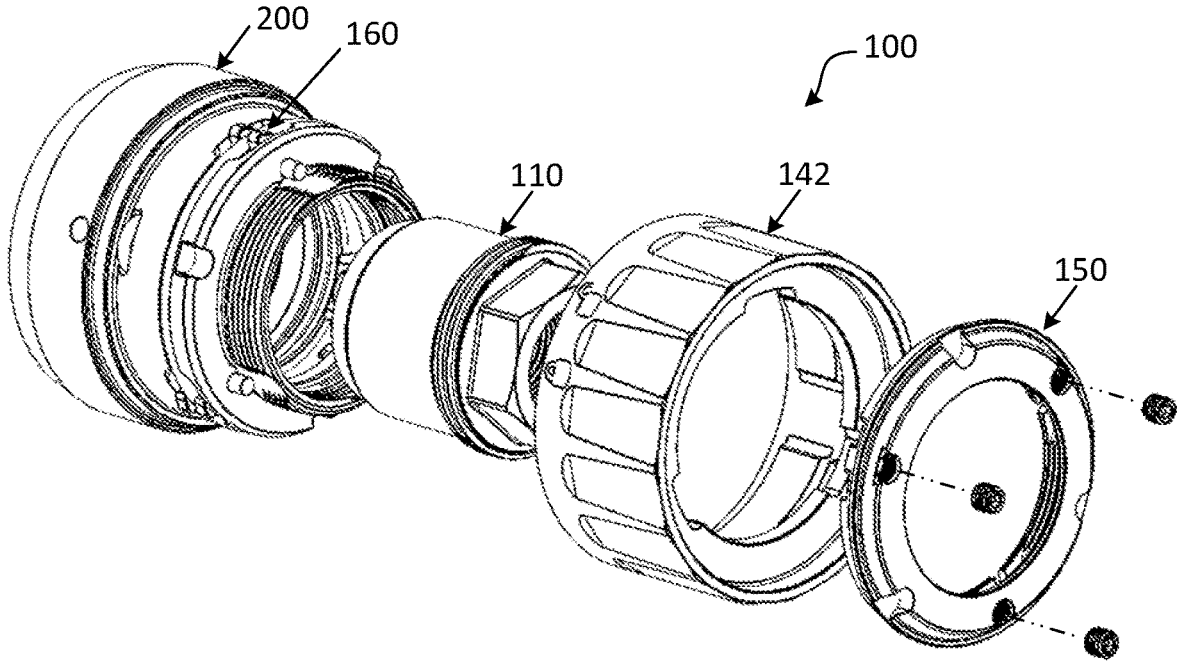
FIG. 1E illustrates an exploded, rear and side perspective view of the mounting assembly shown in FIG. 1D.
Figure 1F:
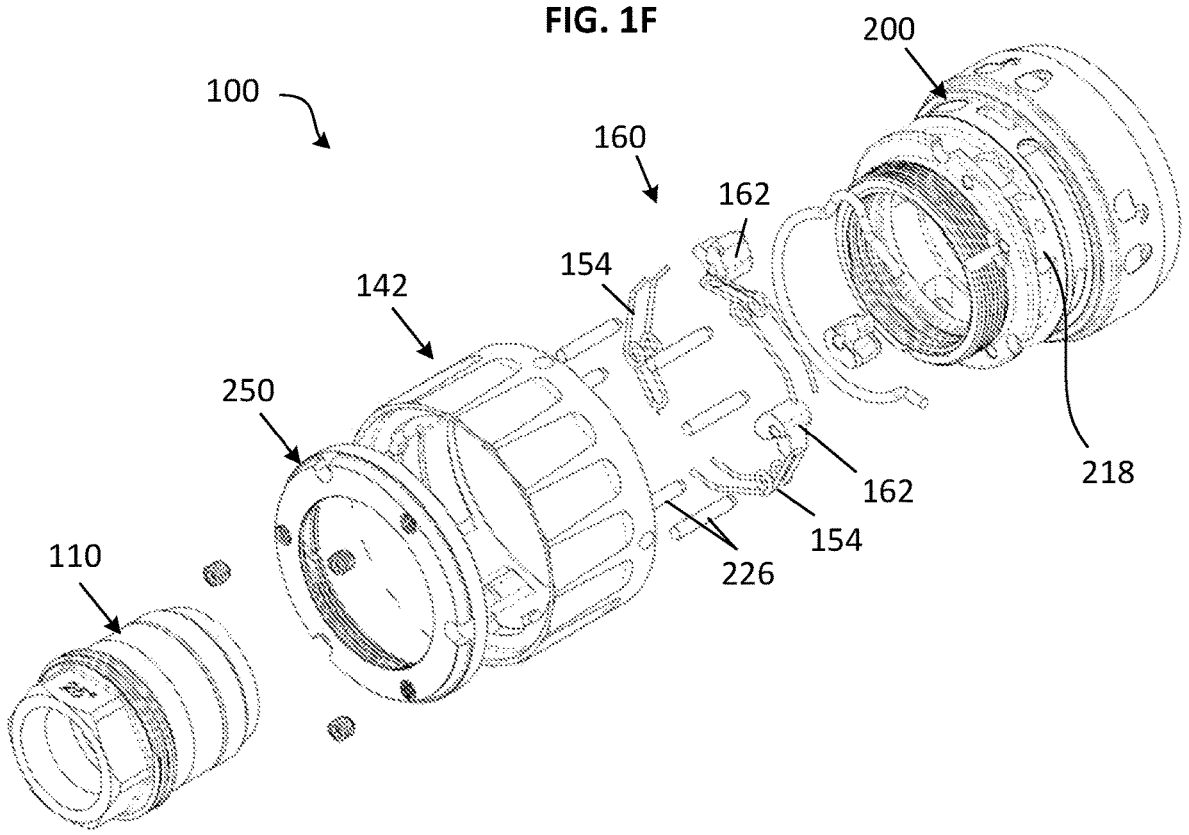
FIG. 1F illustrates an exploded rear perspective view of a mounting assembly where the locking assembly includes torsion springs, in accordance with an embodiment of the present disclosure.

FIGS. 1A-1C illustrate a mounting assembly 100 in accordance with an embodiment of the present disclosure, where FIG. 1A is a front and left-side perspective view showing the clutch assembly 140 in an unlocked position, FIG. 1B is a rear and left-side perspective view showing the clutch assembly 140 in a locked position, and FIG. 1C is a top plan view showing the mounting assembly 100 with the clutch assembly 140 in the locked position and positioned adjacent a threaded end portion 510 of a barrel 505. FIG. 1D illustrates an exploded front and left-side perspective view and FIG. 1E illustrates an exploded rear and left-side perspective view showing components of the mounting assembly 100, in accordance with one embodiment of the present disclosure. FIG. 1F illustrates an exploded rear perspective view showing components of a mounting assembly in accordance with another embodiment of the present disclosure. Due to the similarities among the various embodiments, the mounting assemblies 100 of FIGS. 1A-1F will be discussed concurrently.

In one embodiment, the mounting assembly 100 includes an attachment mount 200, a clutch assembly 140, and a muzzle adapter 110. The attachment mount 200 is releasably attachable to the muzzle adapter 110 and can be secured or locked to the muzzle adapter 110 by the clutch assembly 140 to prevent inadvertent disassembly. The clutch assembly 140 includes a clutch collar 142 that can be installed on and overlaps a portion of the attachment mount 200. The clutch collar 142 is rotatable about the attachment mount 200 and allows frictional engagement of a locking structure 160 to inhibit inadvertent disassembly of the attachment mount 200 from the muzzle adapter 110. In some embodiments, a locking nut 250 attaches to a proximal end portion 204 of the attachment mount 200 to retain the mounting assembly 100 in assembled form. Components of the attachment mount 100 will be discussed in more detail below.

In one embodiment, the muzzle adapter 110 is configured to be attached to the barrel 505, such as by screwing the muzzle adapter 110 onto the threaded end portion 510. The attachment mount 200 can be removably attached to the muzzle adapter 110, such as by threaded engagement, a bayonet mount, or other means. The attachment mount 200 has a distal end portion 202 configured to be secured to a muzzle attachment 515 (shown in FIGS. 20-21), such as a suppressor, muzzle brake, or the like. In one example, the muzzle attachment 515 can be screwed into the distal end portion 202 of the attachment mount 200. In other embodiments, the attachment mount 200 can be permanently attached to or formed as a single piece with the muzzle attachment, including a welded connection.

Figure 2A:
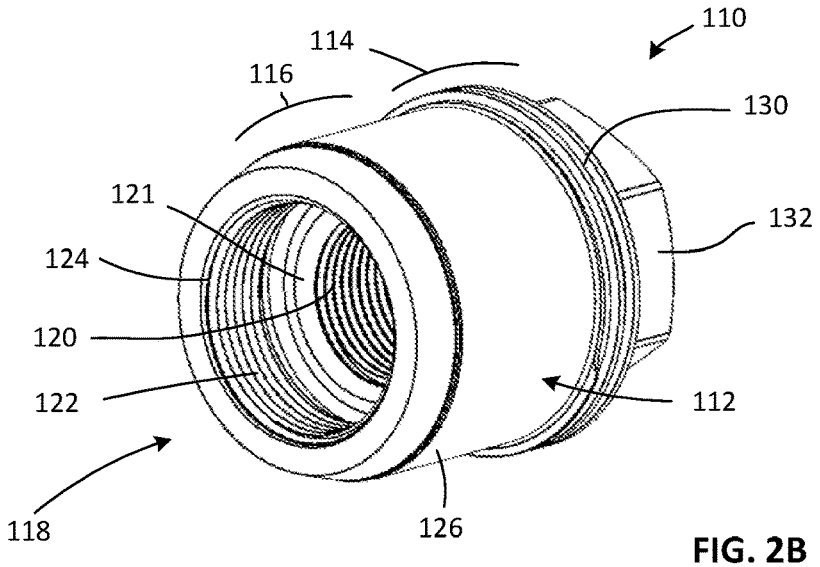
FIG. 2A illustrates a front and side perspective view of a muzzle adapter in accordance with an embodiment of the present disclosure.
Figure 2B:
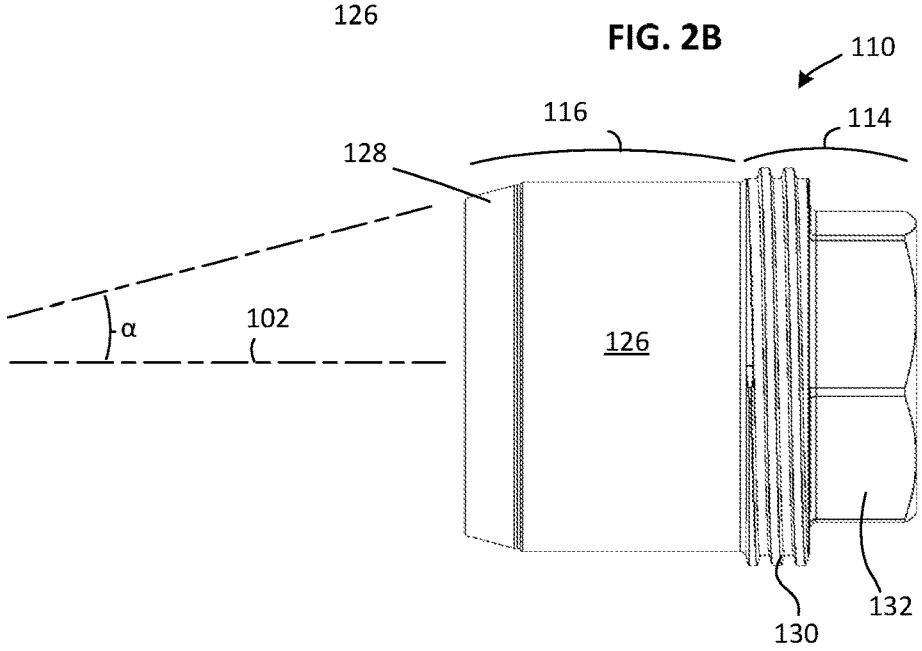
FIG. 2B illustrates a side elevational view of the muzzle adapter of FIG. 2A.
Figure 2C:
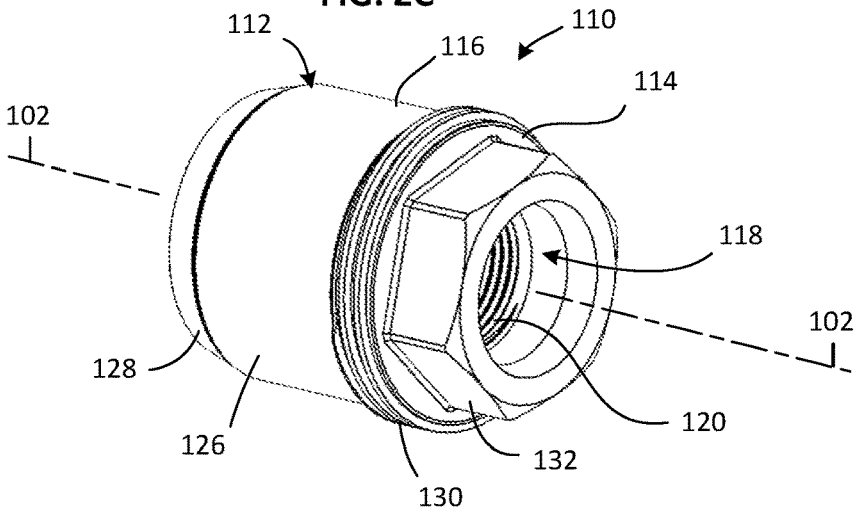
FIG. 2C illustrates a rear and side perspective view of the muzzle adapter of FIG. 2A.
Figure 2D:
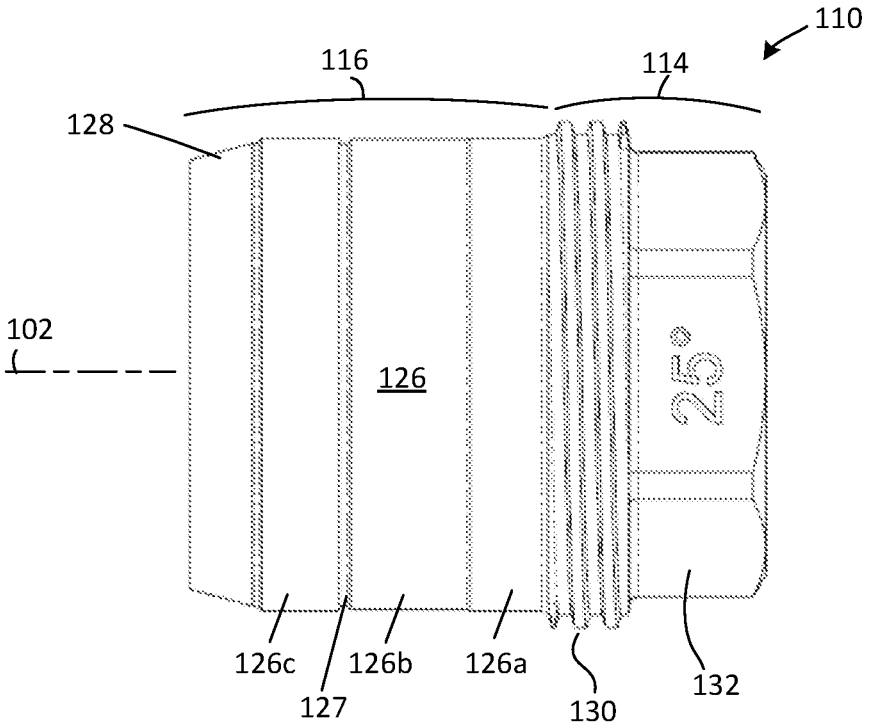
FIG. 2D illustrates a side elevational view of another embodiment of the muzzle adapter with a region of reduced diameter, in accordance with an embodiment of the present disclosure.
Figure 2E:
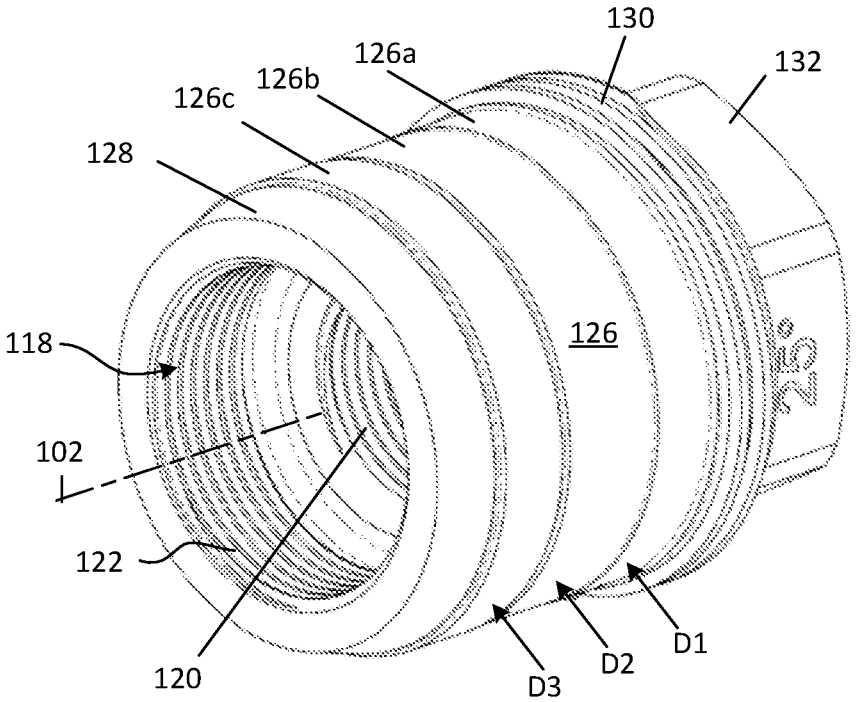
FIG. 2E illustrates a front and side perspective view of the muzzle adapter of FIG. 2D.
Figure 2F:
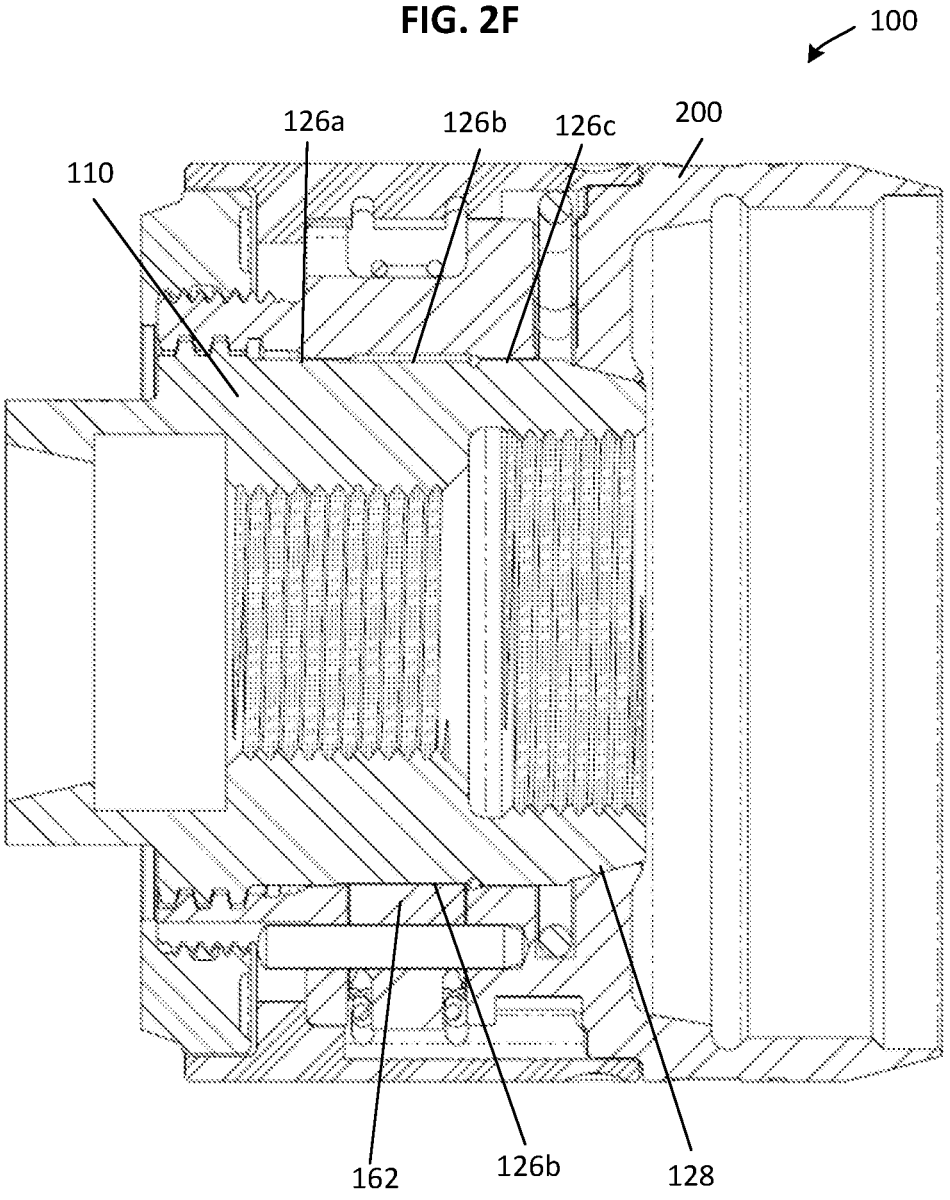
FIG. 2F illustrates a cross sectional view of a mounting assembly including muzzle adapter of FIGS. 2D-2E, in accordance with an embodiment of the present disclosure.

Referring now to FIGS. 2A-2F, various views illustrate a muzzle adapter in accordance with some embodiments of the present disclosure. FIG. 2A is a distal-end perspective view, FIG. 2B is a side view, and FIG. 2C is a proximal-end perspective view of a muzzle adapter 110 in accordance with one embodiment of the present disclosure. FIG. 2E is a side view and FIG. 2F is a distal-end perspective view of a muzzle adapter in accordance with yet another embodiment of the present disclosure. The muzzle adapter 110 has an adapter body 112 with a proximal end portion 114 and a distal end portion 116. A central opening 118 extends through the adapter body 112 along bore axis 102. Muzzle adapter 110 is configured to be attached to the muzzle-end of a barrel 505 of a host firearm 500. In some embodiments, the muzzle adapter 110 has a female thread 120 (e.g., a first or proximal female thread 120) in proximal end portion 114 that mates with a corresponding male thread on the muzzle-end of the barrel 505. For example, the female thread 120 is a ½-28 thread or other suitable size and pitch, as will be appreciated. In some embodiments, the muzzle adapter 110 includes a second or distal female thread 122 along the inside of the distal end portion 116, where the second female thread 122 is configured for threaded attachment of a muzzle device, such as a muzzle brake. In one embodiment, the second female thread 122 has a larger diameter than first female thread 120 and defines a shoulder 121 between the proximal female thread 120 and the distal female thread 122. In other embodiments, the inside sidewall 124 of distal end portion 116 is smooth. The muzzle adapter 110 optionally includes a corrosion-resistant coating, such as a diamond-like carbon (DLC), a physical vapor deposition (PVD) coating of metal or a metal alloy, a manganese phosphate coating, or a nitride coating.

In one embodiment, such as shown in FIGS. 2A-2D, the distal end portion 116 of the adapter body 112 includes a sleeve portion 126 with a generally smooth, cylindrical outer sidewall. Optionally, the sleeve portion 126 has a taper 128 at the distal end 116*a*. In some embodiments, the taper 128 defines a taper angle α greater than 10° with respect to the bore axis 102 (i.e., greater than 20° including opposite tapers), including 12°, 14°, 16°, 18°, or 20°, for example. A taper 128 with a taper angle α of about 15° or more facilitates alignment to and engagement with another corresponding tapered surface without forming a sealing interface that requires a tool to break the seal. A taper angle α of 10° or less generally results in a sealing interface that can be difficult to break during disassembly.

The proximal end portion 114 of the muzzle adapter 110 defines a male thread 130 for threaded engagement with attachment mount 200. In some embodiments, the proximal end portion 114 defines wrench flats 132 to facilitate tightening the muzzle adapter 110 to the barrel 505 of the host firearm 500. It is contemplated that the muzzle adapter 110 can be secured to the barrel 505 using other removable or permanent methods, including a slip fit with set screws, an interference fit, welding, a bayonet mount, or combination of these structures.

In some embodiments, such as shown in FIGS. 2D-2E, the distal end portion 116 of the muzzle adapter 110 has a stepped sleeve portion 126, where one portion of the sleeve portion 126 has a reduced diameter. The region of reduced diameter functions as an anti-slip feature that reduces or prevents axial movement between the attachment mount 200 and the muzzle adapter 110. The stepped profile of the sleeve portion 126 can also be considered a secondary retention mechanism that retains the attachment mount 200 on the muzzle adapter 110. For example, the middle sleeve portion 126*b* has a reduced diameter that retains the cams 162 in this region along the outer surface due to the cams having to move towards an unlocked state to be able to accommodate the large diameter adjacent the middle sleeve portion 126*b*. The stepped profile of the sleeve portion 126 can be advantageous, for example, when the sleeve portion 126 of the muzzle adapter 110 becomes polished from wear, or when grease or other friction-reducing substance is on the sleeve portion 126. In such conditions, the difference in diameter along the sleeve portion 126 can prevent or reduce axial movement between the attachment mount 200 and the muzzle adapter 110.

In the example of FIGS. 2D-2E, the sleeve portion 126 has a proximal sleeve portion 126*a* of first outer diameter D1, a middle sleeve portion 126*b* of second outer diameter D2, and a distal sleeve portion 126*c* of third outer diameter D3. The second outer diameter D2 of the middle sleeve portion 126*b* is slightly smaller than the third outer diameter D3 of the distal sleeve portions 126*c*. In one embodiment, the first outer diameter D1 and the third outer diameter D3 are the same, but this condition is not required. Although the first outer diameter D1 is typically equal to the third outer diameter D3, the first outer diameter D1 can be greater or less than the third outer diameter D3, but the first outer diameter D1 of the proximal sleeve portion 126*a* is typically greater than the second outer diameter D2. In one example, the second outer diameter D2 is from 0.002" to 0.010" (e.g., 0.005") smaller than the third outer diameter D3. In another example, the third outer diameter D3 is at least 0.002", at least 0.0025", at least 0.003", at least 0.0035", at least 0.004", at least 0.0045", at least 0.005", at least 0.006", or at least 0.007" greater than the second outer diameter D2. The transition between proximal, middle, and distal sleeve portions 126*a*, 126*b*, 126*c* can be a circumferential groove 127, a sloped transition, or a sudden step, for example.

In accordance with some embodiments, the mounting assembly 100 is constructed so that the middle sleeve portion 126 is positioned to engage the cams 162 of the locking structure 160 when the attachment mount 200 is installed on the muzzle adapter (e.g., the locking taper 128 of the muzzle adapter 110 engages the corresponding taper 128 of the attachment mount 200). FIG. 2F illustrates a sectional view of a mounting assembly 100 that includes the attachment mount 200 installed on the muzzle adapter 110 of FIGS. 2D-2E, where the taper 128 of the muzzle adapter 110 engages the taper 128 of the attachment mount 200 and the mounting assembly 100 is in a locked position. The cam 162 (shown near the bottom of the figure) can be seen engaging the middle sleeve portion 126*b*. Due to the difference in outer diameter between the middle sleeve portion 126*b* and the neighboring proximal and distal sleeve portions 126*a*, 126*c*, the cam 162 must overcome the increase in diameter at the distal sleeve portion 126*c* in order for the attachment mount 200 to move axially to a position where the cams 162 occupy either the proximal or distal sleeve portion 126*a*, 126*c*. Regardless of whether the transition between the middle sleeve portion 126*b* and distal sleeve portion 126*c* is a gradual transition or an abrupt transition, the cams 162 must rotate to a higher energy position (due to spring force of cam spring(s) 154) to increase the clearance between the cams 162 and the sleeve portion 126. Absent moving to the higher energy position, the cams 162 would more tightly engage (i.e., exhibit greater interference with) the larger outer diameter of the distal sleeve portion 126*c* or the proximal sleeve portion 126*a*, thereby restricting axial movement (or "slip") between the attachment mount 200 and the muzzle adapter 110.

Figure 2G:
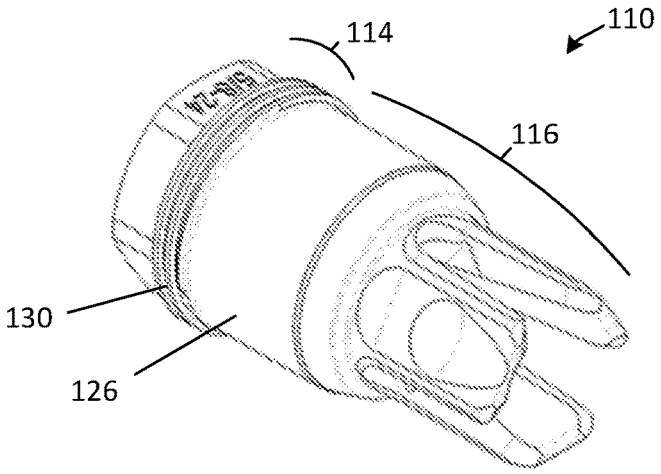
FIGS. 2G-2H illustrate perspective views showing examples of a muzzle adapter configured as a flash hider, in accordance with some embodiments of the present disclosure.
Figure 2H:
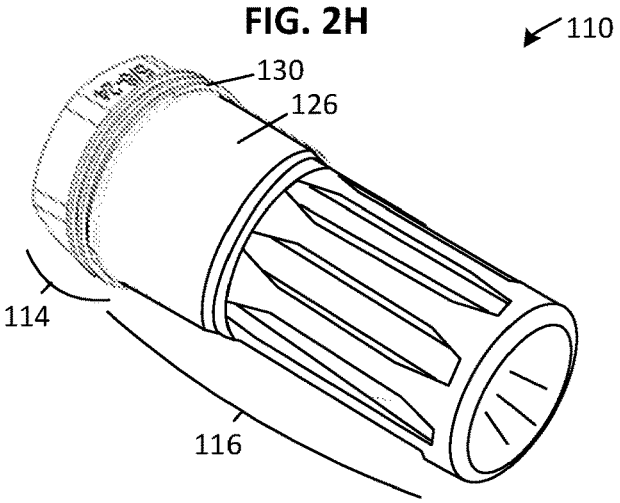
Figure 2I:
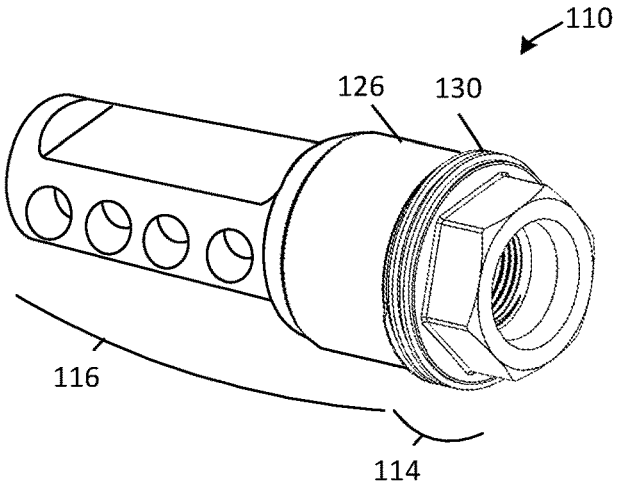
FIG. 2I illustrates a perspective view showing an example of a muzzle adapter configured as a muzzle brake, in accordance with an embodiment of the present disclosure.

FIGS. 2G-2I illustrate perspective views of a muzzle adapter 110 configured as a flash hider or muzzle brake, in accordance with some embodiments. FIGS. 2G and 2H show example embodiments in which the distal end portion 116 is configured as a flash hider. FIG. 2I shows an example embodiment of the muzzle adapter 110 configured as a muzzle brake. As with embodiments above, the proximal end portion 114 can have a thread 130 for engagement with the attachment mount 200 and a cylindrical sleeve portion 126 for engagement with the locking structure 160. While the sleeve portion 126 in FIGS. 2G-2I is shown as a smooth cylindrical surface, the sleeve portion 126 can have a region of reduced diameter, such as discussed above with reference to FIGS. 2D-2F. Numerous variations and embodiments will be apparent in light of the present disclosure.

Figure 3A:
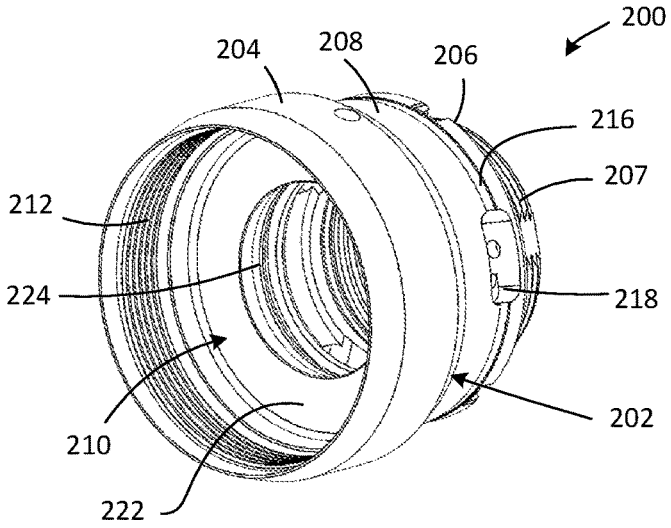
FIG. 3A illustrates a front and side perspective view of an attachment mount, in accordance with an embodiment of the present disclosure.
Figure 3B:
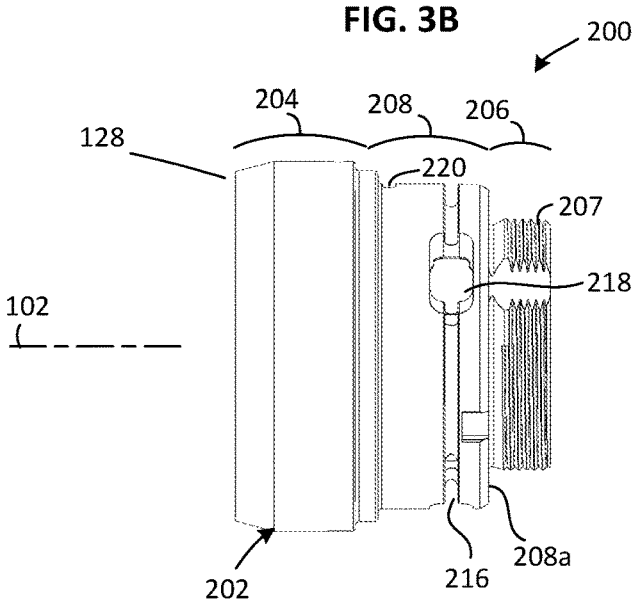
FIG. 3B illustrates a side elevational view of the attachment mount of FIG. 3A.
Figure 3C:
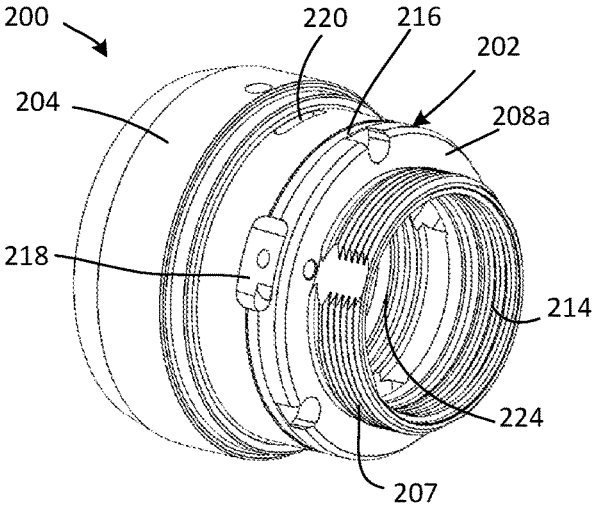
FIG. 3C illustrates a rear and side perspective view of the attachment mount of FIG. 3A.

Referring now to FIGS. 3A-3C, a front perspective view, a side view, and a rear perspective view, respectively, illustrate an attachment mount 200 in accordance with an embodiment of the present disclosure. The attachment mount 200 has a mount body 202 with a mount distal end portion 204 configured to receive and/or attach to a muzzle attachment 515 (shown in FIGS. 20-21), such as a suppressor. For example, the mount distal end portion 204 defines a female thread 212 along an inside surface for threaded engagement with a muzzle attachment. In other embodiments, distal end portion 204 defines a male thread, a smooth surface for a frictional fit or a slip fit, a clamp, or some other suitable attachment structure for a muzzle attachment. A central mount opening 210 extends through the mount body 202 along bore axis 102.

The attachment mount 200 has a mount proximal end portion 206 configured to be removably attached to the muzzle adapter 110. In one embodiment, the inside surface of the mount proximal end portion 206 defines a female thread 214 configured to engage the male thread 130 on the outside of the muzzle adapter 110. In other embodiments, the mount proximal end portion 206 engages the muzzle adapter 110 using a slip fit, a bayonet mount, or other suitable attachment means.

In some embodiments, the attachment mount 200 defines a mount middle portion 208 between the mount distal end portion 204 and the mount proximal end portion 206. For example, the mount middle portion 208 has a different size, such as an intermediate size, compared to the mount distal and proximal end portions 204, 206. Such a configuration may result in the attachment mount 200 having portions of diameters that increase in size from proximal to distal. In other embodiments, for example the mount middle portion 208 has the same size as and may be continuous with the mount proximal end portion and/or the mount distal end portion. In yet other embodiments, the mount middle portion 208 is smaller compared to the mount proximal end portion 206 and the mount distal end portion 204.

Figure 3D:
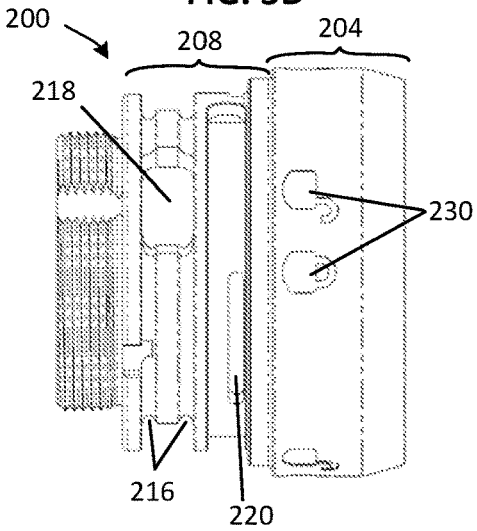
FIG. 3D illustrates a side elevational view of an attachment mount, in accordance with another embodiment of the present disclosure.

In one embodiment, the mount middle portion 208 defines one or more circumferential groove 216 around all or part of the outside surface. The circumferential groove 216 is sized to receive a cam spring 154, such as a wire spring clip, a garter spring, torsion spring, or other suitable spring. The cam spring 154 can be part of the locking structure 160, as will be discussed more fully below. The mount middle portion 208 also defines one or more cam openings 218 along the circumferential groove 216, each of which is sized and configured to accept a cam 162 and allow the cam 162 to pivot. In one embodiment, the cam openings 218 are evenly distributed along the circumferential groove 216. For example, two cam openings are spaced by 180°, three cam openings are spaced by 120°, four cam openings are spaced by 90°, and so on. FIG. 3D illustrates a side view of an attachment mount 200 configured with two circumferential grooves 216, each of which is sized to receive a cam spring 154 or portion thereof. As can be seen in this example, each circumferential groove 216 is positioned along a proximal or distal portion of the cam opening 218 so that the cam spring 154 engages a side portion of the cam body 164, which is discussed in more detail below. Lock/unlock indicia 230 are included on the mount distal end portion 204, which align with a respective indicator on the clutch collar 142 to communicate to the user that the mounting assembly 100 is in a locked or unlocked position.

In some embodiments, the mount middle portion 208 defines a spring opening 220 extending through the sidewall, such as having a shape of an elongated slot, oval, or the like. As shown in FIG. 3B, an inner spring recess 224 can be formed in the inside surface proximal of the annular wall 222 to receive a secondary wire spring 180 with an outward bend 182 that protrudes through the spring opening 220. In some embodiments, the inner spring recess 224 is located proximally of an annular wall 222 that is positioned approximately between mount distal end portion 204 and mount middle portion 208. The secondary wire spring 180 is useful to bias the clutch collar 142 to occupy either the unlocked or locked position by the outward bend 182 occupying a recess in the clutch collar 142, as will be discussed in more detail below.

Figure 4A:
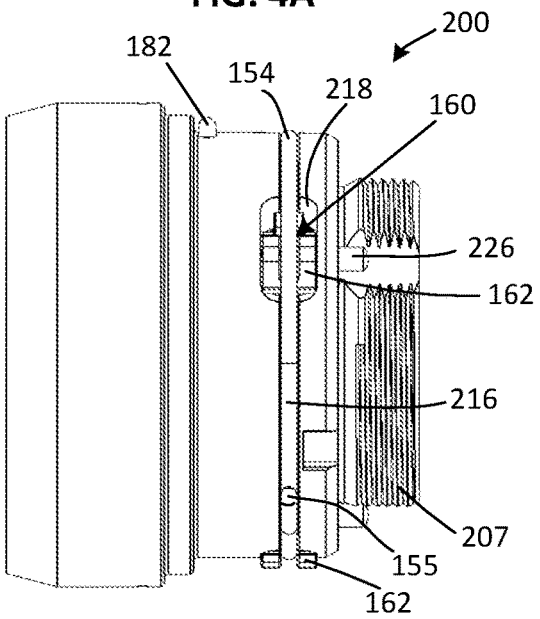
FIG. 4A illustrates a side elevational view of an attachment mount with a locking structure, in accordance with an embodiment of the present disclosure.
Figure 4B:
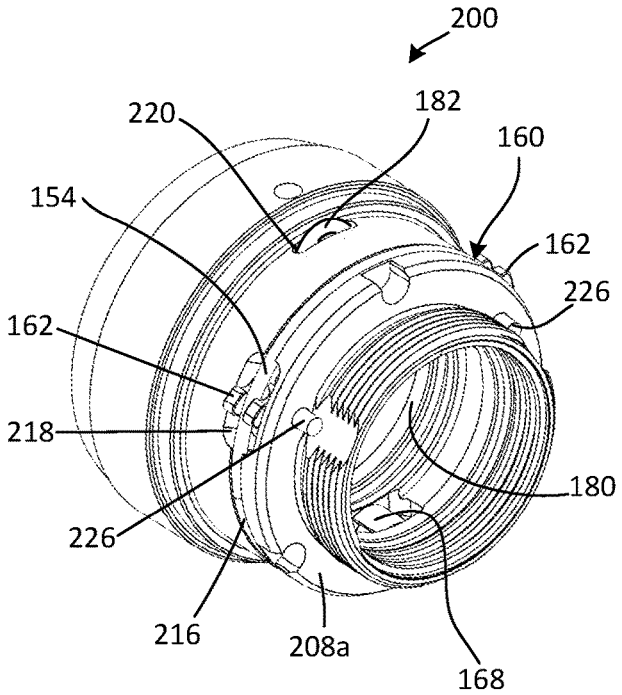
FIG. 4B illustrates a rear perspective view of the attachment mount with locking structure shown in FIG. 4A.
Figure 4C:
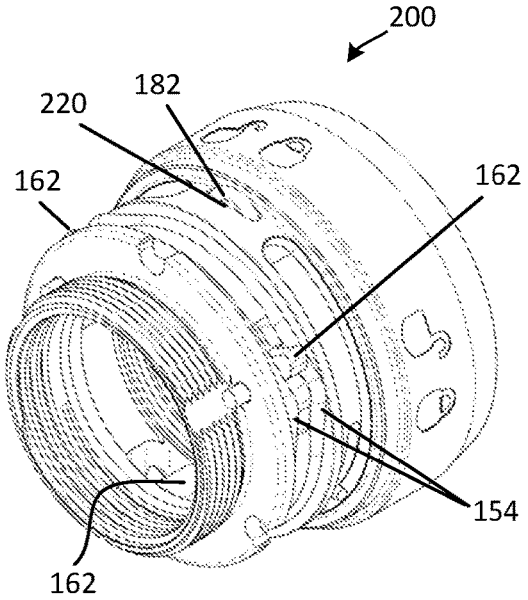
FIG. 4C illustrates a rear perspective view of an attachment mount with a locking structure, in accordance with another embodiment of the present disclosure.
Figure 4D:
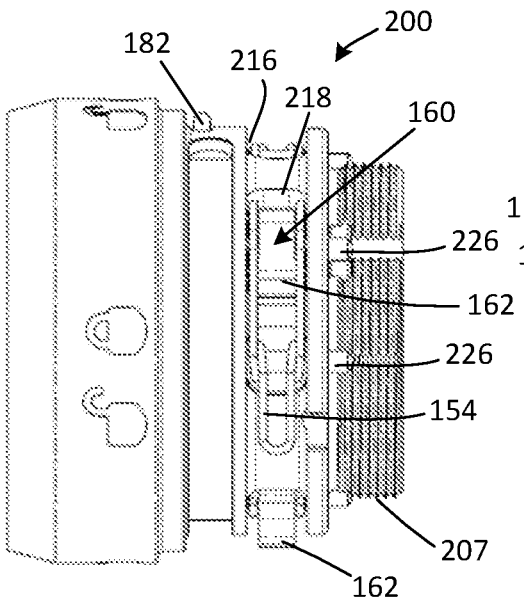
FIG. 4D illustrates a side view of an attachment mount, in accordance with another embodiment of the present disclosure.
Figure 4E:
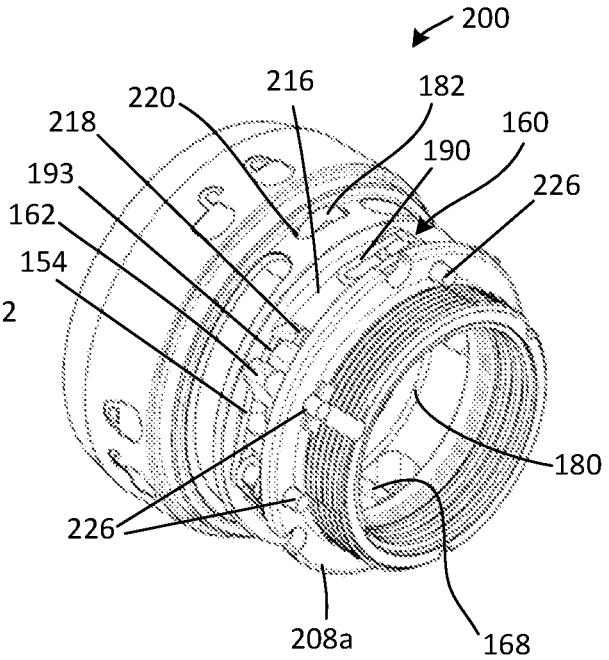
FIG. 4E illustrates a rear perspective view of the attachment mount and locking structure of FIG. 4D.

Referring now to FIGS. 4A and 4B, a side view and a rear perspective view illustrate the attachment mount 200 together with components of a locking structure 160, in accordance with an embodiment of the present disclosure. FIG. 4C illustrates a rear perspective view of an attachment mount 200 in accordance with another embodiment, and FIGS. 4D-4E illustrate side and rear perspective views of an attachment mount 200 in accordance with yet another embodiment. The embodiments of FIGS. 4A-4E will be discussed concurrently. The locking structure 160 includes at least one cam 162, with each cam disposed in a cam opening 218. Each cam 162 is retained by and can pivot about a dowel pin 226 or the like. In combination with the clutch collar 142, which is discussed below, the cams 162 can be rotated to frictionally engage the sleeve portion 126 of the muzzle adapter 110 when the clutch collar 142 is moved to a locked position. When the clutch collar 142 is moved to the unlocked position, the cams 162 rotate in the opposite direction to disengage from the muzzle adapter 110. It is contemplated that the cams 162 could similarly engage another structure attached to the muzzle adapter 110, such as a ring, sleeve, or the like.

In the embodiment of FIGS. 4A-4C, a cam spring 154 extends around the mount middle portion 208 in a tensioned state (i.e., expanded) and is at least partially received in the circumferential groove 216. The cam spring 154 contacts a portion of each cam 162. In one embodiment, for example, the cam spring 154 has a bend 155 with a first end 154*a* received in an opening located along the circumferential groove 216. With the first end 154*a* retained in a fixed location, the cam spring 154 extends along the radially outside portion of each cam 162 to a free second end 154*b*. As the cams 162 rotate between different positions, the cam spring 154 in turn changes between larger and smaller diameters and applies a spring force to the cams 162.

FIG. 4C illustrates a rear perspective view of an attachment mount 200 configured with a pair of cam springs 154, in accordance with another embodiment of the present disclosure. In this example, each cam spring 154 is configured as a garter spring, which is discussed in more detail below with reference to FIG. 6B. Note that for clarity of illustration each cam spring 154 is illustrated as a solid body without coil detail. Similar to the embodiments of FIGS. 4A-4B, each cam spring 154 engages the cams 162 and applies a radially inward spring force to bias the cams 162 towards the locked position.

In the embodiment of FIGS. 4D-4E, the cam springs 154 are configured as double torsion springs with first legs 190 and second legs 192. In this embodiment, each cam spring 154 is retained by a dowel pin 226 extending through the loop 194 of the torsion spring. Note that dowel pins 226 also retain the cams 162, for a total of six dowel pins 226 in this example. The first legs 190 of each cam spring 154 engage the mount body along the circumferential groove 216 and the end portion 193 of second legs 192 of each cam spring 154 engage the cam 162.

As also shown in FIGS. 4A-4E, the outward bend 182 of the secondary wire spring 180 protrudes through the spring opening 220 to engage the clutch collar 142 and bias the clutch collar 142 to occupy either the locked or unlocked position, in accordance with some embodiments. The remainder of the secondary wire spring 180 is retained in a spring recess 224 along the inside of the mount middle portion 208.

Figure 5A:
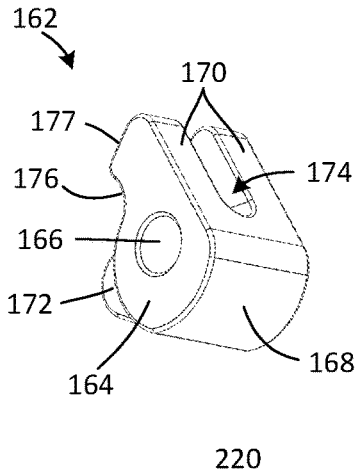
FIG. 5A illustrates a front perspective view of a cam having a lever arm and a second arm, in accordance with an embodiment of the present disclosure.
Figure 5B:
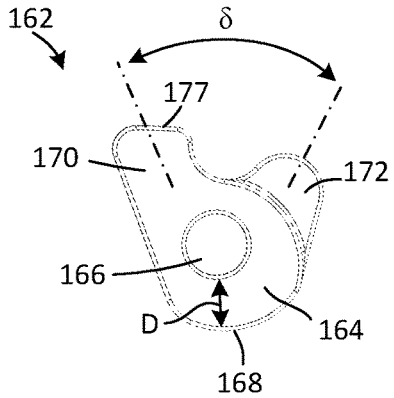
FIG. 5B illustrates a rear elevational view of the cam shown in FIG. 5A.
Figure 5C:
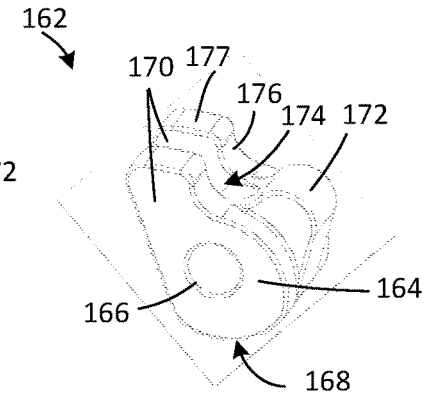
FIG. 5C illustrates rear perspective view of the cam shown in FIG. 5A.
Figure 5D:
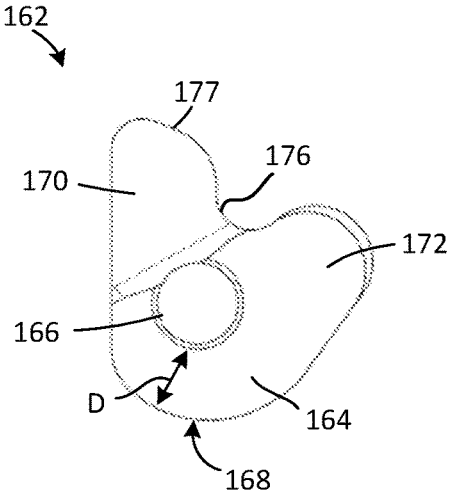
FIG. 5D illustrates a side elevational view of a cam, in accordance with another embodiment of the present disclosure.
Figure 5E:
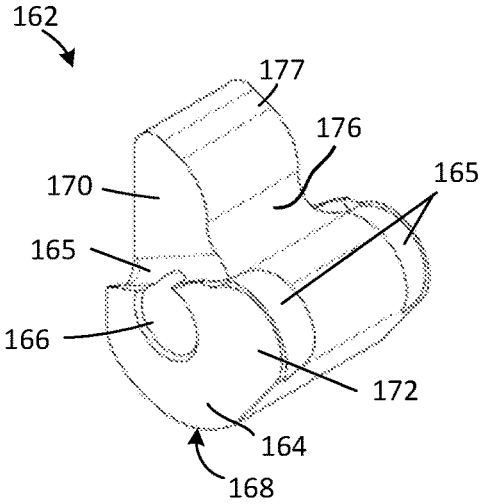
FIG. 5E illustrates a perspective view of the cam of FIG. 5D, in accordance with an embodiment of the present disclosure.

Referring now to FIGS. 5A-5C, a bottom perspective view, a side view, and a top perspective view, respectively, illustrate a cam 162 in accordance with an embodiment of the present disclosure. FIGS. 5D and 5E illustrate a side view and a perspective view, respectively, of a cam 162, in accordance with another embodiment. In these example embodiments, cam 162 includes a cam body 164 with a pin opening 166 therethrough for rotation about a dowel pin 226, fastener, or the like. The cam body 164 has an arcuate cam surface 168 that is eccentric about the pin opening 166. That is, the radial distance D from the pin opening 166 to the cam surface 168 changes along the cam surface 168. The cam surface 168 is configured to engage the sleeve portion 126 of the muzzle adapter 110 when the attachment assembly 100 is in the locked position. In some embodiments, the cam surface 168 follows the shape of a logarithmic or equiangular spiral. In other embodiments, the cam surface 168 is an arc, which closely approximates a logarithmic or equiangular spiral along short distances, as will be appreciated. Other cam shapes are acceptable provided that the cam surface 168 increasingly engages the muzzle adapter 110 when rotated in one direction and decreasingly engages the muzzle adapter 110 when rotated in the opposite direction, as will be appreciated.

The cam 162 includes a lever arm 170 extending radially outward from the cam body 164. In one embodiment, the lever arm 170 has catch 176 defined by a concave face adjacent a corner formed with an end face 177 of the lever arm 170. In one embodiment the end face 177 has a generally arcuate form with its curvature equal to or larger than the curvature of the inside surface 143*b* of the clutch collar 142. In other embodiments, the end face can be flat 177. For example, the catch 176 facilitates engagement with a surface moving towards the lever arm 170 in a direction perpendicular to the axis of rotation about the pin opening 166. The catch 176 could similarly be defined, for example, by a protrusion or other geometry that provides a suitable surface to engage the clutch collar 142. One example of such a surface defines an angle of 90° or less with respect to the surface contacting the lever arm 170, as will be appreciated.

Figure 6A:
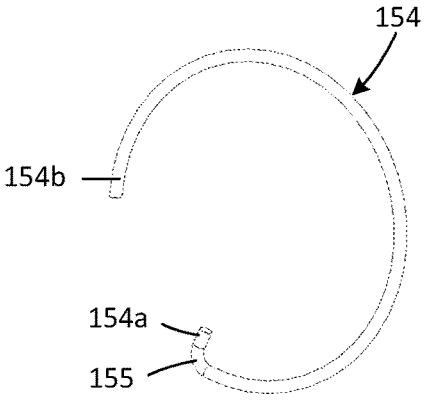
FIG. 6A illustrates a cam spring, in accordance with an embodiment of the present disclosure.
Figure 6B:
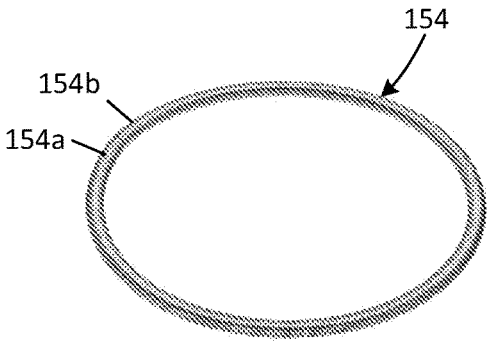
FIG. 6B illustrates a cam spring configured as a garter spring, in accordance with another embodiment of the present disclosure.
Figure 6C:
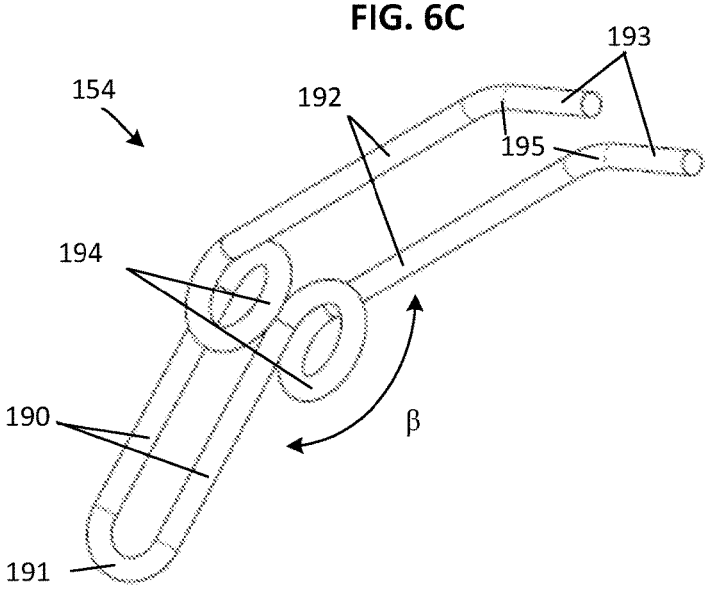
FIG. 6C illustrates a cam spring configured as a double torsion spring, in accordance with another embodiment of the present disclosure.

In one embodiment, such as shown in FIGS. 5A-5C, the lever arm 170 has a split or forked design with two portions arranged in a generally parallel, spaced-apart configuration. In such a configuration the lever arm 170 accommodates the cam spring 154 in a gap 174 between the portions of the lever arm 170. In other embodiments, the cam spring 154 (or a pair thereof) contacts the cam body 164 along an outer face of the lever arm 170. In other embodiments, such as shown in FIGS. 5D-5E, a single lever arm 170 extends from the cam body 164 and is constructed to permit a cam spring 154 to engage the cam body 164 on either or both sides of the lever arm 170. In the example of FIGS. 5D-5E, the lever arm 170 is centrally located between spring grooves 165 that extend along portions of the cam body 164. The spring grooves 165 promote the desired position of the cam spring 154 on the cam body 164 by providing a slightly recessed position of lower energy. Here, the spring grooves 165 have a concave shape consistent with a circular profile of a cam spring 154 made of circular wire. Accordingly, the cam spring 154 can make contact with the spring groove 165 at more than one point in contrast to single point contact between a cylindrical spring and a flat or relatively flat surface. The cam 162 of FIGS. 5D-5E is constructed for use with cam springs 154 having, for example, a generally circular or hoop shape, such as shown in FIGS. 6A-6B, or with a torsion spring, such as shown in FIG. 6C. Examples of cam springs 154 are discussed in more detail below. Numerous variations and embodiments will be apparent in light of the present disclosure.

The cam 162 includes a protrusion or second arm 172 extending radially outward from the cam body 164. When viewed from the side as in FIG. 5B or 5D, the second arm 172 is rotated by an angle δ about 0-90° from lever arm 170, including 20-90° such as 30-60°, or about 45°, thereby defining a V shape with the cam body 164 in some embodiments. In other embodiments, the second arm 172 is generally aligned with the lever arm 170, where angle δ is from 0-5°, for example. In one embodiment, the lever arm 170 extends generally opposite of part of the cam surface 168 having the greatest distance D to the pin opening 166. Accordingly, when the cam surface 168 engages the sleeve portion 126 of the muzzle adapter 110, the lever arm 170 generally extends radially outward (e.g., ±20°) and is therefore positioned to engage the clutch collar 142 as it moves between the locked and unlocked positions, in accordance with some embodiments.

In one embodiment, such as shown in FIGS. 5A-5C, the second arm 172 is aligned with the gap 174 between the spaced-apart portions of the lever arm 170. Thus, when the cam spring 154 is received in the gap 174, the second arm 172 can rotate to contact the cam spring 154 in some positions of the cam 162. In the various embodiments, the cam spring 154 applies a spring force to the second arm 172 that biases the cam 162 towards the locked position. This spring force is overcome when the user rotates the clutch collar 142 to the unlocked position. In doing so, the second arm 172 rotates into the cam spring 154 to expand the cam spring 154. The cams 162 may be alternately or additionally rotated by direct engagement with the lever arm 170, such as by contact with the clutch collar 142.

The cam 162 can be configured to prevent over-rotation. For example, as the cam 162 rotates through the locked position, the cam spring 154 will contact the cam body 164 in the gap 174 between the split lever arm 170 portions. Similarly, in the embodiment shown in FIGS. 5D-5E, the cam spring can engage the cam body 164 along opposite sides of the lever arm 170. In such positions, the cam spring 154 may be unable to further contract to a smaller size (or position of lower energy) and also may no longer apply the spring force to the second arm 172. Similarly, the second arm 172 can be sized to expand the cam spring 154 to abut the inside of the clutch collar 142 when moved to the unlocked position. In absence of the muzzle adapter 110 to stop rotation of the cam 162 due to physical interference, this feature may be used as a stop to prevent over-rotation in the direction of the locked position, also referred to as the "free" position.

FIG. 6A illustrates a perspective view of a cam spring 154 in accordance with an embodiment of the present disclosure. The cam spring 154 is configured as a wire spring that extends from a first end 154*a* to a second end 154*b* along a generally circular path, where the first end 154*a* and second end 154*b* are discontinuous. In some embodiment, the cam spring 154 has a bend 155 adjacent first end 154*a*. In one embodiment, the bend 155 is about 90°; other angles for the bend 155 are acceptable. In other embodiments, the first end 154*a* defines a loop, hook, or other catch structure. Accordingly, the first end 154*a* can be installed into an opening, engage a catch surface, or otherwise be maintained in a fixed position on the attachment mount 200. With the first end

154*b* of the cam spring 154 retained in the opening, the cam spring 154 expands or contracts as the cams 162 rotate from one position to another.

Although the cam spring 154 is described in some embodiments as being a wire spring clip installed around the attachment mount 200 in an expanded state, other configurations of the cam spring 154 are acceptable. For example, the cam spring 154 can be a wire spring installed in a compressed state along the inside circumference of the attachment mount. In other embodiments, the cam spring 154 can be a coil spring, torsion spring, or other suitable spring. Depending on the configuration, the cam spring 154 can apply a spring force in a radially inward direction, a radially outward direction, or some other direction that biases the cam 162 towards the locking position. Numerous variations and embodiments will be apparent in light of the present disclosure.

FIG. 6B illustrates a perspective view of a cam spring 154 with a garter spring configuration, in accordance with another embodiment of the present disclosure. In this example, the cam spring 154 is essentially a helical coil assembled into a closed loop. In some embodiments, for example, the closed loop can be formed by threading the tapered first end 154*a* portion of the helical coil into the second end 154*b* portion.

FIG. 6C illustrates a perspective view of a cam spring 154 configured as a double torsion spring, in accordance with another embodiment of the present disclosure. In other embodiments, the cam spring 154 can be a single torsion spring with similar construction or two single torsion springs arranged in parallel, as will be appreciated. In this example, the cam spring 154 has first legs 190 connected to second legs 192 by a loop 194 between each first leg 190 and second leg 192. The first legs 190 are joined at their distal end by a bridge portion 191. Each of the second legs 192 includes a slight bend 195 adjacent the end portion 193. In its resting state in this example, a torsion spring (or double torsion spring as shown here) defines an angle β the first legs 190 and second legs 192 of less than 180°. The spring can be placed in a higher energy state (e.g., a compressed state) by moving the first arms 190 towards the second arms 192 and reducing the angle β. The spring can also be placed in a higher energy state (e.g., an expanded state) by moving the first arms 190 away from the second arms 192 and increasing the angle β. In one embodiment, the cam spring 154 is installed in the attachment mount 200 with a pin 226 extending through the loop 194 and the cam spring 154 is positioned so that the bridge portion 191 (or first leg(s) 190) engages the mount body and the end portion 193 of each second leg 192 can engages the cam 162 in at least some positions of the cam 162. For example, the end portions 193 engage spring grooves 165 of the cam 162 in most cam positions (shown in FIGS. 5D-5E). When the cam spring 154 is configured as a torsion spring, the mounting assembly 100 may benefit from increased reliability. For example, if one torsion spring fails, it may affect the operation of the particular cam it engages, whereas a failure of a circular spring can affect the function of all cams 162.

Figure 7:
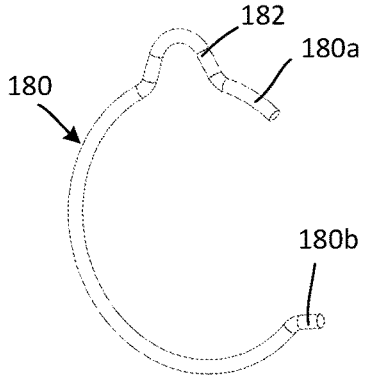
FIG. 7 illustrates a secondary spring, in accordance with an embodiment of the present disclosure.

FIG. 7 illustrates a perspective view of the secondary wire spring 180, in accordance with an embodiment of the present disclosure. The secondary wire spring 180 extends from a first end 180*a* to a second end 180*b* along a generally circular path, where the first end 180*a* is discontinuous with the second end 180*b*. For example, the secondary wire spring 180 spans about 270° of a circle from first end 180*a* to second end 180*b*. In one embodiment, the secondary wire spring 180 includes a protrusion or outward bend 182 that deviates radially outward from the circular shape. The outward bend 182 is positioned to protrude through the spring opening 220 in the mount body 202 as discussed above. The secondary wire spring 180 is not essential to the operation of the mounting assembly 100, but is useful to reduce or prevent excess movement in the clutch collar 142, to define energetically preferred positions for the clutch collar 142 (either locked or unlocked), and to give the user tactile feedback when the clutch collar 142 is moved from one position to another.

Figure 8A:
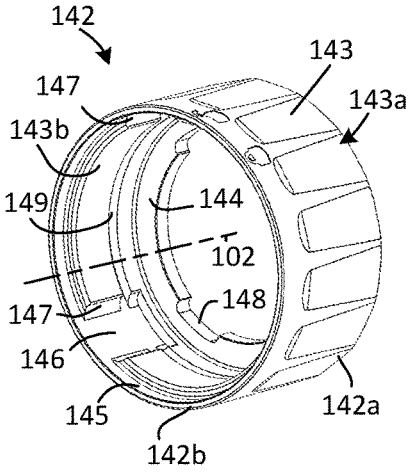
FIG. 8A illustrates a front and side perspective view of a clutch collar, in accordance with an embodiment of the present disclosure.
Figure 8B:
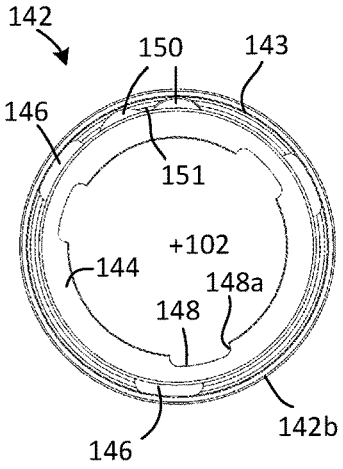
FIG. 8B illustrates a front elevational view of the clutch collar of FIG. 8A.
Figure 8C:
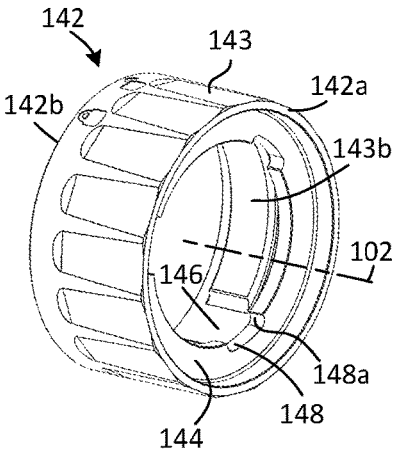
FIG. 8C illustrates a rear and side perspective view of the clutch collar of FIG. 8A.

Referring now to FIGS. 8A-8C, a front perspective view, a front elevational view, and a rear perspective view, respectively, illustrate a clutch collar 142 in accordance with an embodiment of the present disclosure. The clutch collar 142 has a cylindrical collar body 143 extending along the bore axis 102 from a proximal end 142*a* to a distal end 142*b*. The clutch collar 142 is configured in some embodiments to overlap all or part of the mount proximal end portion 206 and the mount middle portion 208 of the attachment mount 200 (shown in FIGS. 3A-3C). In other embodiments, for example the collar body 143 overlaps and rotates only about the mount middle portion 208 and is retained between the mount distal end portion 204 and an end cap or locking nut 250 secured to the mount proximal end portion 206, as will be appreciated. In one embodiment, the collar body 143 has a rim 145 of reduced thickness adjacent the distal end 142*b* that overlaps a corresponding region of the attachment mount 200 that is adjacent the mount distal end portion 204.

In some embodiments, the collar body 143 optionally has an outside surface 143*a* that facilitates being gripped by a user. For example, the outside surface 143*a* includes a surface coating, grooves, knurling, or other feature suitable to facilitate rotation by the user in a variety of operating environments.

An inside 143*b* of the collar body 143 is configured to accommodate and operate with the locking structure 160. In the embodiment of FIGS. 8A-8C, the inside 143 defines one or more axial slots or clearance recesses 146 that correspond to components of the locking structure 160, such as cams 162. The inside 143*b* also defines a circumferential groove 149 to receive the cam spring 154 when it is in its expanded state (e.g., unlocked position). As the clutch collar 142 rotates between the unlocked position and the locked position, each clearance recess 146 provides space for the cam 160 to rotate. When moving between the locked and unlocked positions, for example, the lever arm 170 can occupy various positions in the clearance recess 146. In an unlocked position, the lever arm 170 is positioned so that the end face 177 of the lever arm 170 is generally tangential to and slides along the inside 143*b* of the clutch collar 142, which prevents rotation of the cam 162 towards the lower-energy state of the locked position, in accordance with some embodiments.

In some embodiments, the clearance recesses 146 are shaped to include recess sidewalls 147 that engage the lever arm 170 and rotate the cam 162 into or out of engagement with the muzzle adapter 110. Direct engagement with the lever arm 170 may occur, for example, when moving the clutch collar 142 to the unlocked position. In the unlocked position, the cam spring 154 is converted to a higher-energy state because it is expanded to a larger size. In one embodiment, one of the recess sidewalls 147 directly engages the lever arm 170 to rotate the cam 162 against the force of the cam spring 154 acting on the second arm 172. This movement to the unlocked position causes the second arm 172 to expand the cam spring 154 and the cam surface 168 to disengage from the muzzle adapter 110. In contrast, when rotating to the locked position, the cam spring 154 seeks to occupy the lower-energy state of a smaller circumference and applies a force to the second arm 172, thereby rotating the cam 162 to the locked position with the cam surface 168 engaging the muzzle adapter (when present). Since the cam spring 154 preferentially moves to the lower-energy condition of the less expanded state, the cam 162 does not require direct engagement from the clutch collar 142 to rotate towards the locked position.

In one embodiment, the inside 143*b* of the clutch collar 142 defines one or more spring recesses 150 adjacent the rim 145. The clutch collar 142 can define a spring recess 150 for each of one or more desired positions of the clutch collar 142, such as the locked position and the unlocked position. Each spring recess 150 can have a shape corresponding to that of the outward bend 182 of the secondary wire spring 180. In each of the locked and unlocked positions of the clutch collar 142, for example, the outward bend 182 occupies a respective one of the spring recesses 150. When the clutch collar 142 is rotated, a ramp 151 between the spring recesses 150 engages the outward bend 182 of the secondary wire spring 180 and compresses the spring radially inward towards the bore axis 102. After passing the ramp 151, the spring expands and the outward bend 182 again occupies one of the spring recesses 150. In some embodiments, the user may feel the secondary wire spring 180 "snap" or settle into place when the clutch collar 142 is moved to either the locked or the unlocked positions. In other embodiments, the clutch collar 142 may define only one spring recess 150 corresponding to a preferred position of the clutch collar 142 (e.g., the locked position). In yet other embodiments, the clutch collar 142 defines more than two spring recesses 150, some or all of which can correspond to a particular position.

The clutch collar 142 includes a proximal wall 144 with an annular shape that connects to an inside of the collar body 143 at or near the proximal end 142*a*. The proximal wall 144 extends radially inward toward the bore axis 102. In one embodiment, the proximal wall 144 defines notches 148 corresponding in location to pins 226 (shown in FIG. 4B) extending through each of the cams 162. In some embodiments, each notch 148 defines stop surfaces 148*a* that contact the corresponding pin 226 to prevent over rotation of the clutch collar 142 when moving to either of the locked or unlocked positions.

The proximal wall 144 may abut or be positioned closely adjacent the proximally-facing surface 208*a* of the mount middle portion 208. Accordingly, the rim 145 at the distal end 142*b* and the proximal wall 144 near the proximal end 142*a* can function as stops to prevent the clutch collar 142 from moving distally along the attachment mount 200. A locking nut 250, snap ring, cap, or other device installed on the mount proximal end portion 206 to fix the proximal position of the clutch collar 142 along the attachment mount. Accordingly, removal of the locking nut 250 or other structure would allow disassembly of the mounting assembly 100 for service or repair, as will be appreciated.

Figure 8D:
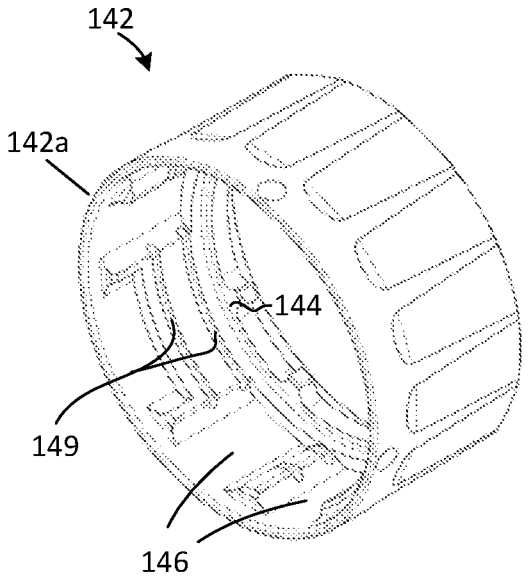
FIG. 8D illustrates a front perspective view of a clutch collar, in accordance with another embodiment of the present disclosure.
Figure 8E:
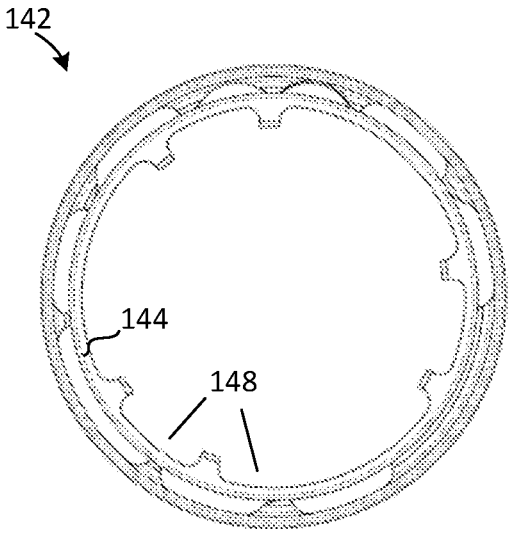
FIG. 8E illustrates a front view of the clutch collar of FIG. 8D.

FIGS. 8D and 8E illustrate a perspective view and an end view, respectively of a clutch collar 142, in accordance with another embodiment of the present disclosure. This example embodiment is similar in structure and operation to the clutch collar 142 of FIGS. 8A-8C, with a few exceptions. In this embodiment, the inside of the clutch collar 142 defines two circumferential grooves 149 to provide clearance for cam springs 154, whether configured as a torsion spring or circular spring. The clutch collar 142 also defines additional clearance recesses 146 to accommodate the pins that may be used to retain the torsion springs on the attachment mount 200. Also, the proximal wall 144 defines additional notches 148 to provide clearance for pins 226 used to retain torsion springs. Lands 159 between notches 148 are positioned to engage the lever arm 170 of the cams 162 when the assembly is in a locked position.

Figure 9A:
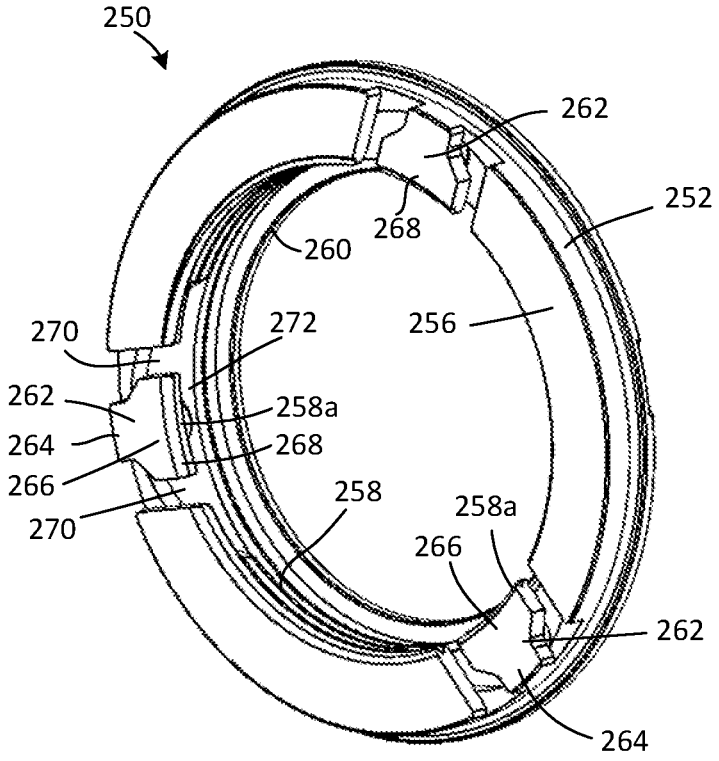
FIG. 9A illustrates a distal perspective view of a locking nut with resilient tabs, in accordance with an embodiment of the present disclosure.
Figure 9B:
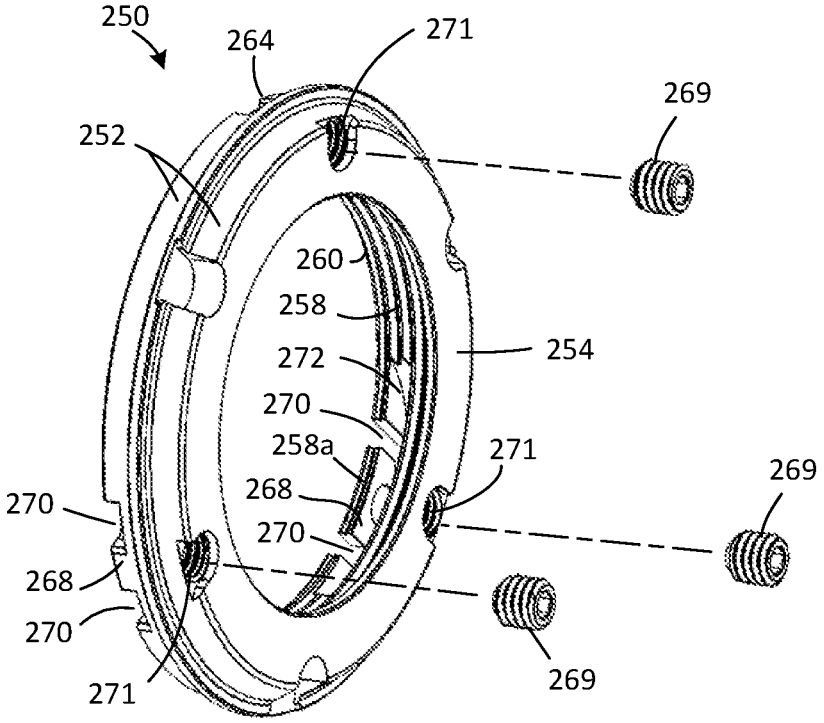
FIG. 9B illustrates an exploded proximal and side perspective view of the locking nut and fasteners, in accordance with an embodiment of the present disclosure.

Referring now to FIGS. 9A-9B, front and rear perspective views, respectively, show a locking nut 250 in accordance with an embodiment of the present disclosure. The locking nut 250 has an annular nut body 252 with a proximal face 254 and a distal face 256. The nut body 252 defines a female thread 258 along a radially inner surface 260. The nut body 252 defines one or more tabs 262 with a radially outer end portion 264 attached to the nut body 252 at a radially outer position on the nut body 252 and extending unattached radially inward to an inner end portion 266 with an inner tab end 268. The inner tab end 268 includes a portion 258*a* of the female thread 258. A fastener 269 can be advanced axially through the nut body 252 to contact the tab 262. For example, as the fastener 269 is advanced axially through the nut body 252, it engages the radially inner end portion 266 of the tab 262 and deflects it axially, thereby misaligning the tab portion of the female thread 258*a* with respect to the primary portion of the female thread 258 along the radially inner surface 260. This misalignment causes the tab portion of the female thread 258*a* and to frictionally engage the corresponding male thread 207 on the mount proximal end portion 206. As such, the locking nut 250 resists unscrewing from the attachment mount 200 due to vibration or the like.

A locking nut 250 in accordance with the present disclosure can be made using a variety of methodologies, as will be appreciated. In one embodiment, the female thread 258 is defined along the radially inner surface 260. Slots 270 are cut axially into the nut body 252 to define the general shape of the tab 262. An undercut 272 is then defined that extends radially outward between the tab 262 and the remaining portion of the nut body 252. Threaded openings 271 can then be formed through the nut body 252 to the undercut 272. Additional finishing and machining can be performed as needed to shape the tab 262 as desired.

Embodiments of the locking nut 250 in accordance with the present disclosure advantageously provide a compact structure that screws onto the mount proximal end portion 206 and can be locked in place using one or more fastener 269. Although three fasteners 269 are shown, more or fewer fasteners 269 may be used. It is contemplated that embodiments of the locking nut 250 can be used with the mounting assembly 100, or as part of other mechanical assemblies, as will be appreciated. Numerous configurations and variations will be apparent in light of this disclosure.

Figure 10:
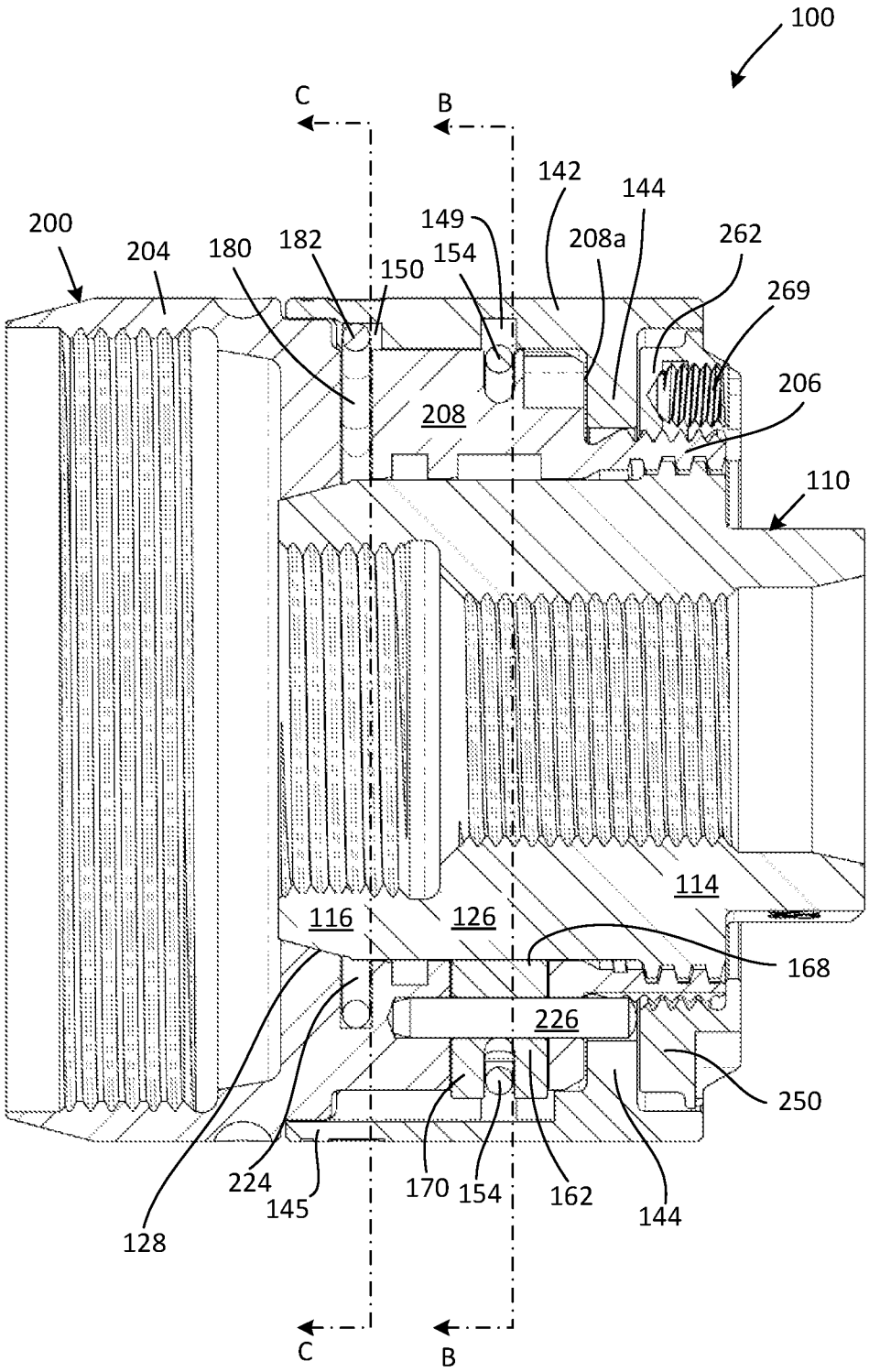
FIG. 10 illustrates a cross-sectional view of a mounting assembly taken along line A-A of FIG. 1C, in accordance with an embodiment of the present disclosure.

Referring now to FIG. 10, a cross-sectional view taken along line A-A of FIG. 1C illustrates the mounting assembly 100 in accordance with an embodiment of the present disclosure. The mounting assembly 100 is assembled with the attachment mount 200 threaded onto the muzzle adapter 110. The taper 128 on the distal end portion 116 of the muzzle adapter 110 mates with a corresponding taper defined inside the attachment mount 200. The secondary wire spring 180 is received in the inner spring recess 224 with the outward bend 182 extending through the attachment mount 200 and received in a spring recess 150 in the clutch collar 142. The clutch collar 142 overlaps the mount middle portion 208 and part of the mount proximal end portion 206. The proximal wall 144 of the clutch collar 142 is against or close to the proximally-facing surface 208*a* of the mount middle portion 208. The rim 145 of the clutch collar 142 overlaps the attachment mount 200 adjacent the mount distal end portion 204. As illustrated, the cam spring 154 has the smaller size associated with the locked position, and is positioned between portions of the lever arm 170. The cam spring 154 can be expanded in the unlocked position to occupy the circumferential groove 149 in the clutch collar 142. A cam 162 is shown with the cam surface 168 engaging the sleeve portion 126 of the muzzle adapter 110. A dowel pin 226 extends axially through the cam 162 and into the attachment mount 200. The locking nut 250 is threaded onto the proximal end portion 206 of the muzzle attachment 200 to maintain the assembled structure of the mounting assembly 100. The fastener 269 is advanced through the locking nut 250 to engage the tab 262 of the locking nut 250.

The axial position of the clutch collar 142 on the attachment mount 200 is limited or maintained by one or more stop points in the mounting assembly 100. One stop point is the proximally-facing surface 208*a* of the mount middle portion 208, which limits the distal position of the clutch collar by contact with the proximal wall 144. The proximal wall 144 also abuts or is closely adjacent the locking nut 250 installed on the proximal end portion 114 of the muzzle adapter 110. Another stop point is the distal end 142*b* or rim 145 of the clutch collar 142 abutting the mount distal end portion 204. Another stop point is the cam spring 154 retained partially in the circumferential groove 149 along the inside 143*b* of the clutch collar 142 and partially in the circumferential groove(s) 216 in the outside surface of the attachment mount 200, in accordance with some embodiments. Yet another stop point is the outward bend 182 engaging one of the spring recesses 150 adjacent the rim 145 of the clutch collar 142. One or more of these stop points may be utilized to maintain or limit the axial position of the clutch collar 142 with respect to the attachment mount 200.

Figure 11A:
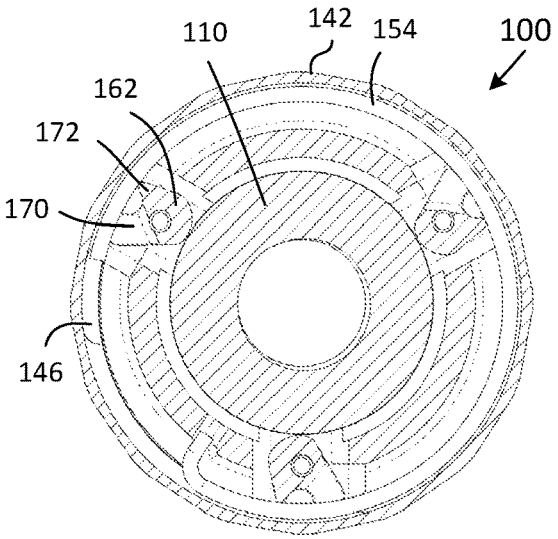
FIG. 11A illustrates a cross-sectional view of a mounting assembly taken along line B-B of FIG. 10 and shows the clutch assembly in an unlocked position, in accordance with an embodiment of the present disclosure.
Figure 11B:
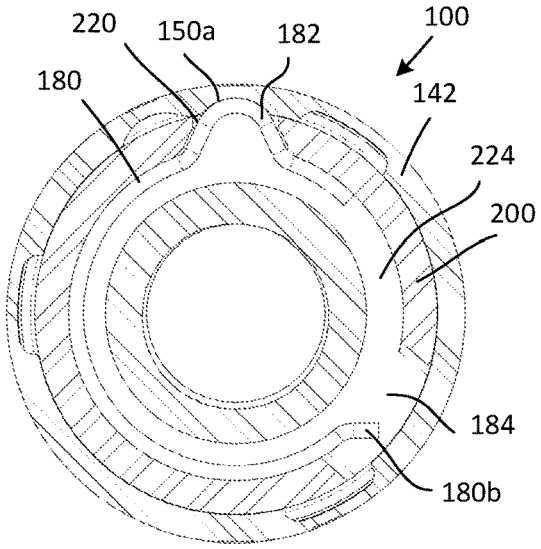
FIG. 11B illustrates a cross sectional view of a mounting assembly taken along line C-C of FIG. 10 and shows part of the secondary spring occupying a recess in the clutch collar in an unlocked position, in accordance with an embodiment of the present disclosure.

Turning now to FIGS. 11A and 11B, cross-sectional views illustrate one embodiment of the mounting assembly 100 in an unlocked position as taken along line B-B and line C-C, respectively, of FIG. 10. Both sections B-B and C-C show the mounting assembly 100 as viewed looking distally through the mounting assembly 100. FIG. 11A shows the clutch assembly 140 in the unlocked position. As illustrated in this embodiment, the locking structure 160 includes cams 162 and cam spring 154. Each cam 162 is rotated so that the thickness of the cam body 164 from the pin opening 166 to the cam surface 168 is minimized or reduced to provide clearance between the cam 162 and the muzzle adapter 110. As such, the cams 162 are disengaged from the muzzle adapter 110. The second arm 172 of each cam 162 extends radially outward and contacts the cam spring 154, maintaining it in a higher-energy, expanded state. In this condition, the cam spring 154 at least partially occupies the circumferential groove 149 defined along the inside 143*b* of the clutch collar 142. At the same time, the cam spring 154 is energized and applies a spring force to the second arm 172 of each cam 162, thereby urging the cams 162 to rotate towards the locked position. However, the cams 162 cannot turn because the end face 177 of each lever arm 170 is positioned outside of the clearance recess 146 and disposed against the inside surface of the clutch collar 142, thereby blocking rotation of the cams 162.

FIG. 11B shows the position of the secondary wire spring 180 in the unlocked position. The secondary wire spring 180 is in a compressed state, so it wants to expand radially outward against the inner spring recess 224 along the inside of the attachment mount 200. As such, the outward bend 182 is urged to protrude through the spring opening 220 in the attachment mount 200 and occupy the spring recess 150*a* corresponding to the unlocked position. The second end 180*b* of the secondary wire spring 180 occupies a void 184 in the attachment mount 200.

Figure 11C:
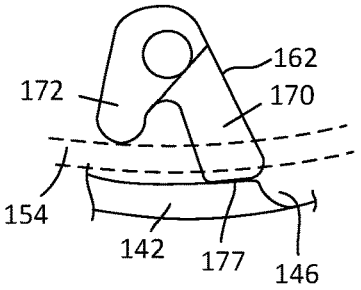
FIG. 11C illustrates a rear elevational view of a cam in an unlocked position with the end of the lever arm positioned along the inside surface of the clutch collar, in accordance with an embodiment of the present disclosure.
Figure 11D:
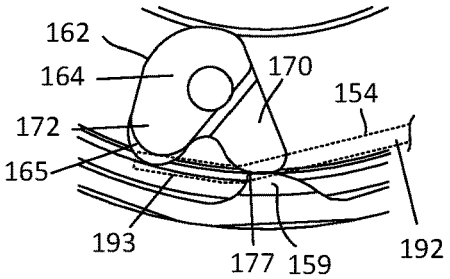
FIG. 11D illustrates a rear elevational view of a cam in an unlocked position and engaged by a torsion spring, in accordance with an embodiment of the present disclosure.

FIG. 11C illustrates an example position of the cam 162 in which the end face 177 is positioned outside of the clearance recess 146 and therefore is in contact with the clutch collar 142. The cam spring 154 is illustrated in broken lines for clarity. FIG. 11D illustrates a cam 162 in an unlocked position with the end face 177 of the lever arm 170 engaging a land 159 on the inside of the clutch collar 142. In this figure, the cam spring 154 is shown in broken lines to more clearly illustrate the position of the cam 162 with respect to the land 159. In this example, the cam spring 154 is a torsion spring with the end portion 193 of the second leg 192 engaging the spring grooves 165 along the second arms 164. The contact between the land 159 and the cam 162 prevents the cam 162 from rotating to a locked position.

Figure 12A:
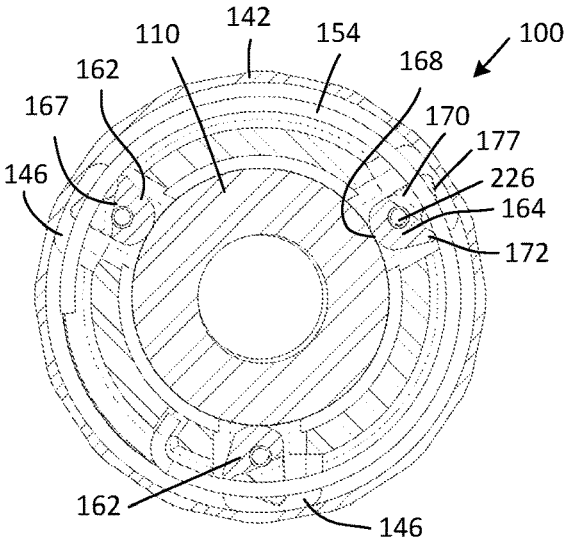
FIG. 12A illustrates a cross-sectional view of a mounting assembly taken along line B-B of FIG. 10 and shows the clutch assembly in a locked position with cams engaging the muzzle adapter, in accordance with an embodiment of the present disclosure.
Figure 12B:
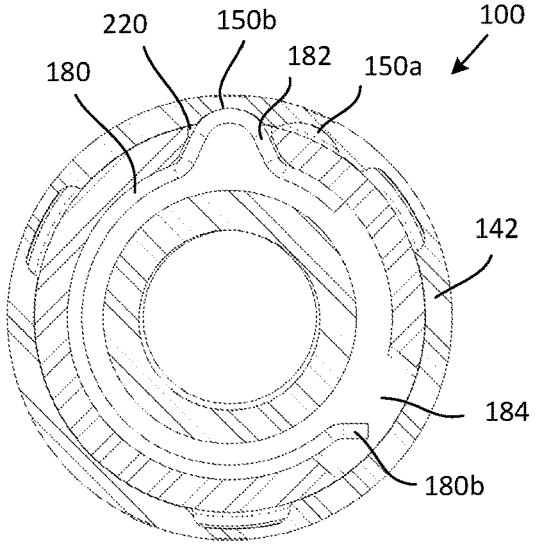
FIG. 12B illustrates a cross-sectional view of a mounting assembly taken along line C-C of FIG. 10 and shows part of the secondary spring occupying a recess in the clutch collar in a locked position, in accordance with an embodiment of the present disclosure.

Turning now to FIGS. 12A and 12B, cross-sectional views illustrate the mounting assembly 100 in a locked position as taken along line B-B and line C-C, respectively, of FIG. 10. When the clutch assembly 140 is in the locked position as shown in FIG. 12A, the cams 162 are rotated so that the cam surface 168 engages the muzzle adapter 110. Each lever arm 170 extends radially outward and occupies a clearance recess 146 defined in the clutch collar 142. The distance from the pin opening 166 to the cam surface 168 is increased to causes the cam surface 168 to engage the muzzle adapter 110. The cam spring 154 has a less expanded state compared to the unlocked position, but is still at tension and applies a radially inward force to the second arm 172 of each cam 162, thereby urging the cams towards more tightly engaging the muzzle adapter 110.

The cam spring 154 is at tension in the expanded state and wants to achieve a smaller size, therefore applying a spring force that rotates the cams 162 further into the locked position with the cam body 164 against the cam spring 154. Further rotation of each cam 162 in a clockwise direction would cause each cam 162 to apply a greater gripping force to the muzzle adapter 110. This additional rotation may occur, for example, due to vibration or due to the user attempting to unscrew the attachment while the mounting assembly 100 is in the locked position. The more torque that is applied to each cam 162, the more tightly the cam surface 168 engages the muzzle adapter 110. In this way, the locking structure 160 is somewhat self-regulating in that a small additional force in the locking direction is countered by small additions to the gripping force by the cams 162. Similarly, large additional forces in the locking direction are countered by large additions to the gripping force of the cams 162.

In the absence of the muzzle adapter 110, the cam spring 154 would further rotate the cams 162 to a "free" position in which the cam spring 154 contacts the dowel pin 226 and flat 167 of the cam 162, in accordance with some embodiments. In such a position, the cam spring 154 would not be able to contract further since the cam spring 154 contacts and is stopped by the dowel pin 226 and/or flat 167 along the cam 162 in the gap 174 between portions of the lever arm 170, therefore preventing the cam spring 154 from further contracting.

FIG. 12B shows the position of the secondary wire spring 180 in the locked position. As with the unlocked position, the secondary wire spring 180 is in a compressed state, so it wants to expand radially outward against the inner spring recess 224 along the inside of the attachment mount 200. As such, the outward bend 182 is urged to protrude through the spring opening 220 in the attachment mount 200 and occupy the spring recess 150*b* corresponding to the locked position.

Figure 12C:
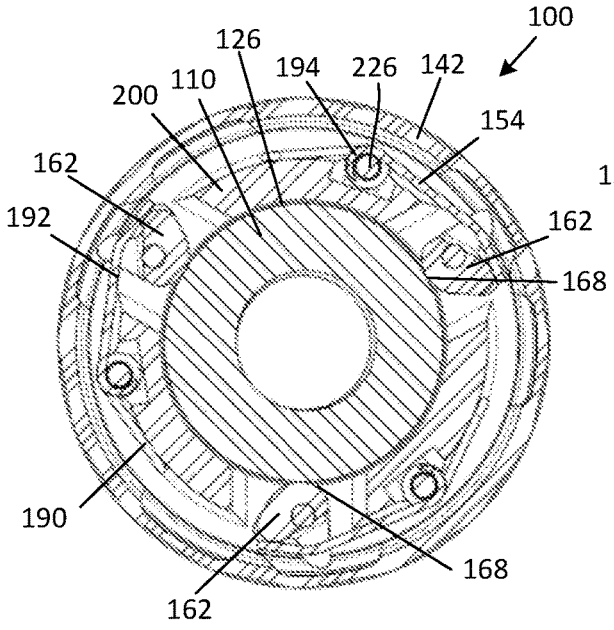
FIG. 12C illustrates a cross-sectional view of a mounting assembly where the cam springs configured as torsion springs and the assembly is shown in a locked position, in accordance with another embodiment of the present disclosure.
Figure 12D:
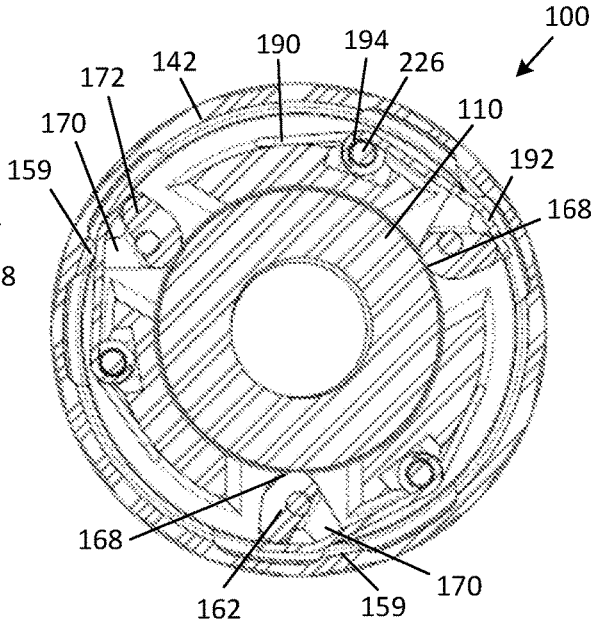
FIG. 12D illustrates a cross-sectional view of the mounting assembly of FIG. 12C shown in an unlocked position, in accordance with an embodiment of the present disclosure.

FIGS. 12C and 12D illustrate cross-sectional views of a mounting assembly 100 and show the locking structure 160 in locked and unlocked positions, respectively, in accordance with an embodiment of the present disclosure. In this example, each cam spring 154 is configured as a double torsion spring that is retained on the attachment mount 200 by a dowel pin 226 extending through the loop 194. The first leg 190 engages the mounting assembly 200 and the end portion 193 of the second leg 192 engages the cam 162. As can be seen in the locked position of FIG. 12C, the cam surface 168 of each cam 162 engages the sleeve portion 126 of the muzzle adapter 110. In the unlocked position of FIG. 12D, the lever arm 170 of each cam 162 engages the land 159 on the clutch collar 142. Each cam 162 has rotated so that the cam surface 168 is out of engagement with the muzzle adapter 110. The second leg 192 of each cam spring 154 has been pushed radially outward to a higher energy state by the second arm 172 of the cam 162.

Figure 13A:
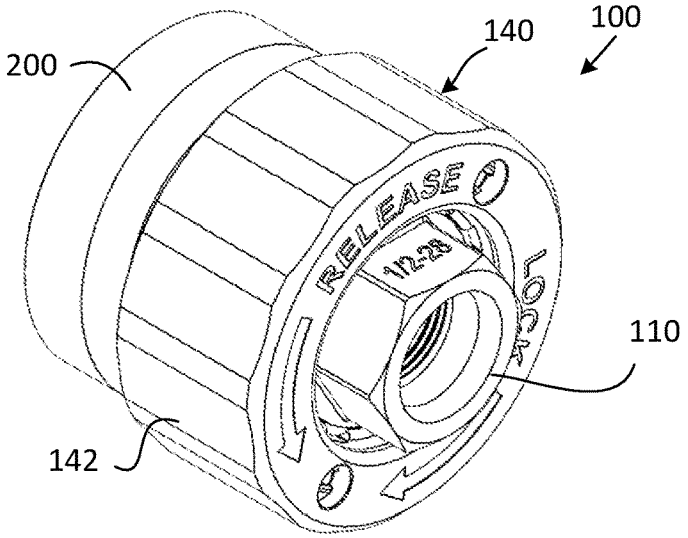
FIG. 13A illustrates a rear and side perspective view of a mounting assembly, in accordance with another embodiment of the present disclosure.
Figure 13B:
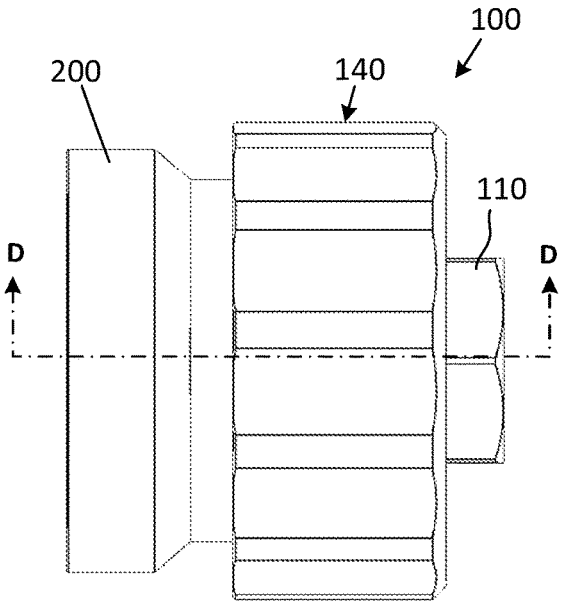
FIG. 13B illustrates a top plan view of the mounting assembly of FIG. 13A.
Figure 13C:
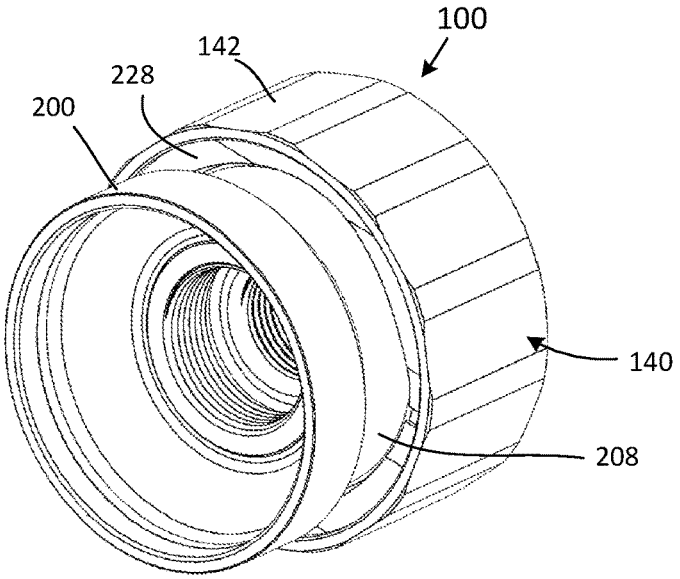
FIG. 13C illustrates a front and side perspective view of the mounting assembly of FIG. 13A.
Figure 13D:
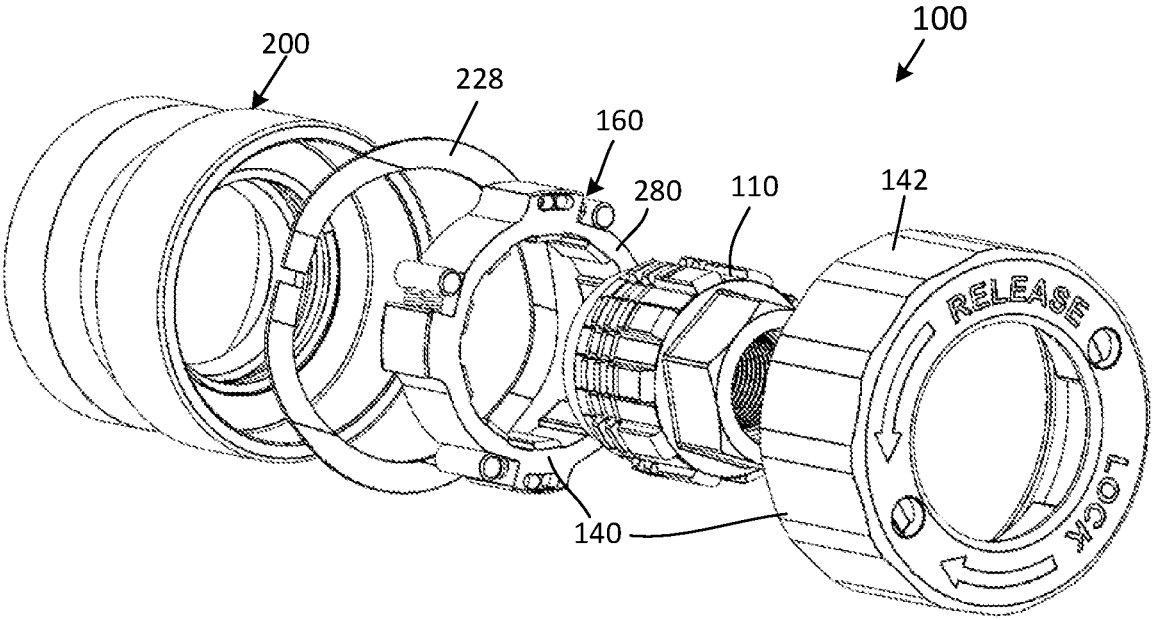
FIG. 13D illustrates an exploded, rear perspective view showing various components of the mounting assembly of FIG. 13A, in accordance with an embodiment of the present disclosure.
Figure 13E:
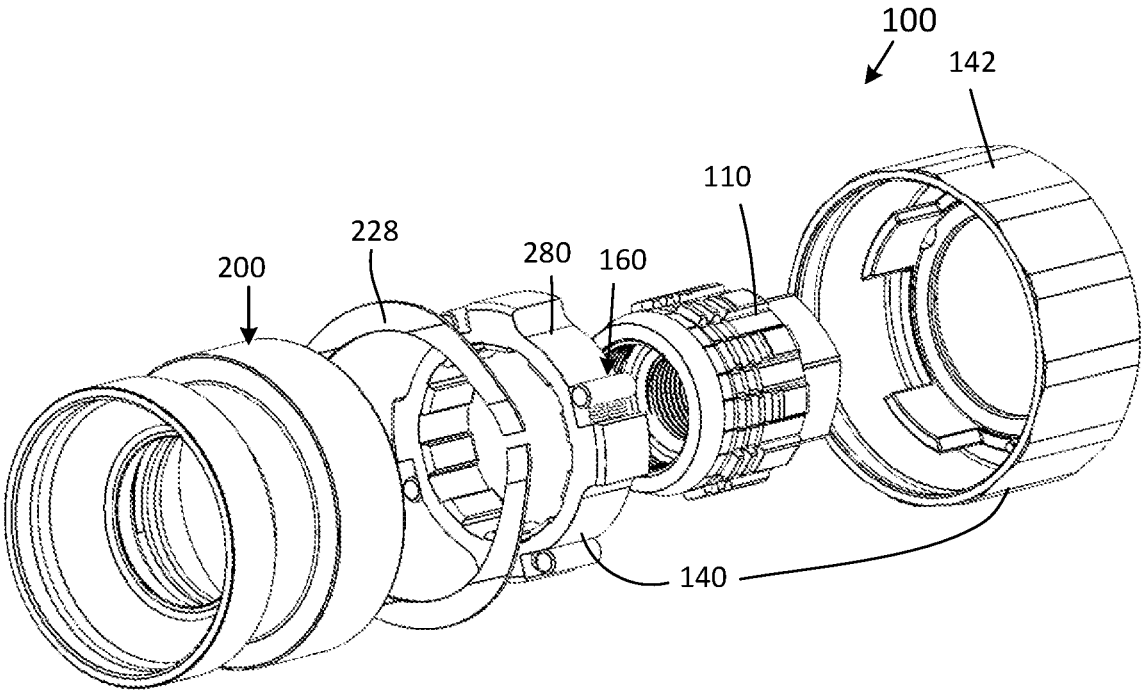
FIG. 13E illustrates an exploded, front perspective view showing the components of the mounting assembly of FIG. 13D.

Referring now to FIGS. 13A-13E, mounting assembly 100 is shown in accordance with another embodiment of the present disclosure. FIG. 13A illustrates a rear and left-side perspective view of the mounting assembly 100; FIG. 13B illustrates a side elevational view of the mounting assembly 100; FIG. 13C illustrates a front and left-side perspective view of the mounting assembly 100; FIG. 13D illustrates an exploded rear and left-side perspective view of the mounting assembly 100; and FIG. 13E illustrates an exploded front and left-side perspective view of the mounting assembly 100. As with some embodiments discussed above, the mounting assembly 100 includes an attachment mount 200, a clutch assembly 140, and a muzzle adapter 110. The attachment mount 200 is releasably attachable to the muzzle adapter 110 and can be secured or locked to the muzzle adapter 110 by the clutch assembly 140 to prevent inadvertent disassembly. However, in contrast to some embodiments discussed above, the clutch assembly 140 of the mounting assembly 100 in this embodiment is structured as a trapped roller clutch. The clutch assembly 140 includes rollers that can become trapped when the clutch collar 142 is rotated to the locking position, but allow the attachment mount 200 to rotate relative to the muzzle adapter 100 (e.g., unscrew) when the clutch collar 142 is moved to the unlocked position. The exploded views of FIGS. 13D and 13E show the clutch assembly 140, which includes the clutch collar 142, the locking structure 160, and the adapter ring 280. Components of the mounting assembly 100 will be discussed below. Due in some cases to having features in common with the embodiments discussed above, emphasis will be given to features that are different.

Figure 14A:
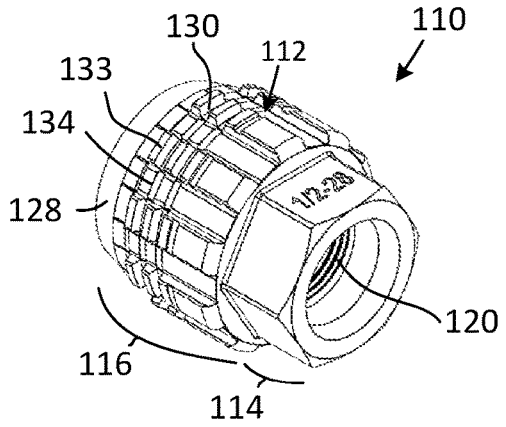
FIG. 14A illustrates a rear perspective view of a muzzle adapter with alternating ridges and valleys that extend axially along the outside surface of the adapter body, in accordance with an embodiment of the present disclosure.
Figure 14B:
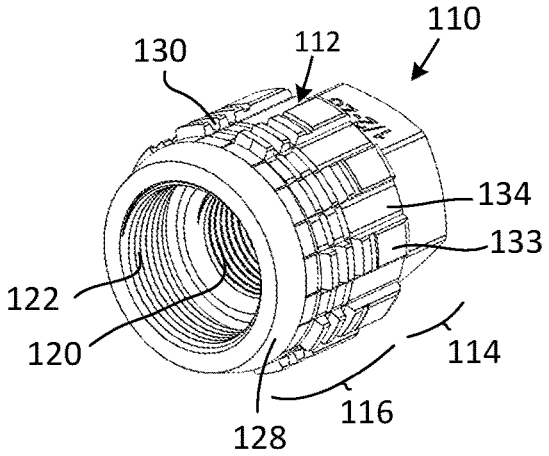
FIG. 14B illustrates a front perspective view of the muzzle adapter of FIG. 14A.
Figure 14C:
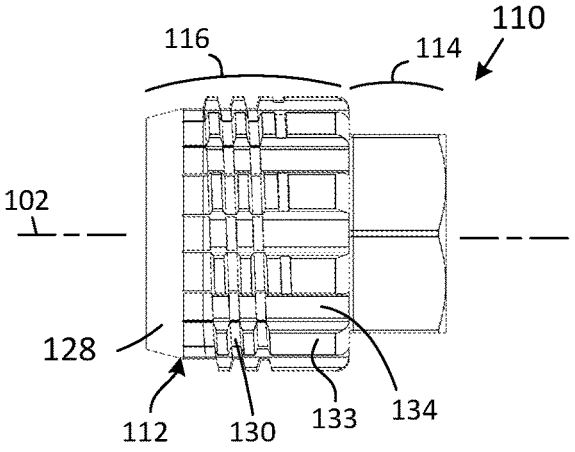
FIG. 14C illustrates a side elevational view of the muzzle adapter of FIG. 14A.

Turning now to FIGS. 14A-14C, a rear perspective view, a front perspective view, and a side view, respectively, illustrate a muzzle adapter 110 in accordance with another embodiment of the present disclosure. In some embodiments, the muzzle adapter 110 is configured with a female thread 120 in the proximal end portion 114 for installation on a threaded end portion 510 of a barrel 505. The muzzle adapter 110 can be configured to threadably engage a muzzle attachment 515 and includes a female thread 122 along the inside surface of the distal end portion 116.

In one embodiment, the muzzle adapter 110 includes one or more ridges 133 extending axially along the adapter body 112. In embodiments with a plurality of ridges 133, the ridges can be separated or interspersed with valleys 134. Although described as valleys 134, such features need not be recessed into the adapter body 112, but can instead be a region of reduced diameter compared to one or more adjacent ridge 133. The ridges 133 and valleys 134 can be distributed evenly or unevenly about the circumference of the adapter body 112, such as in an alternating pattern of ridges 133 and valleys 134. In some embodiments, the ridges 133 and valleys 134 have the same or similar circumferential width, however, this is not required. In other embodiments, the adapter body 112 has two, three, four, or more ridges 133 that may be distributed evenly or unevenly about the circumference. In another embodiment, the adapter body 112 has only one ridge 133 that may be received in a corresponding slot in the adapter ring 280, or vice versa.

In some embodiments, the muzzle adapter 110 defines a male thread 130 along a distal end portion 116 of the adapter body 112. The male thread 130 is configured to threadably engage a female thread 212 in the attachment mount 200. For example, the attachment mount 200 can be screwed onto the muzzle adapter 110. In one embodiment, the male thread 130 crosses (e.g., is cut through) a portion of the ridges 133 and/or valleys 134. In another embodiment, the male thread 130 is cut through only the ridges 133. In yet other embodiments, the male thread 130 is positioned distally of the ridges 133 and does not cut through the ridges 133. Numerous embodiments and variations will be apparent in light of the present disclosure.

Figure 15A:
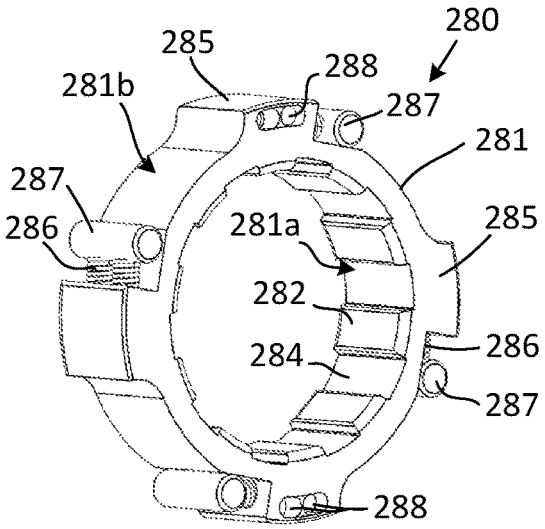
FIG. 15A illustrates a rear perspective view of an adapter ring with an inside surface configured for the muzzle adapter of FIG. 14A and including rollers and roller springs, in accordance with an embodiment of the present disclosure.
Figure 15B:
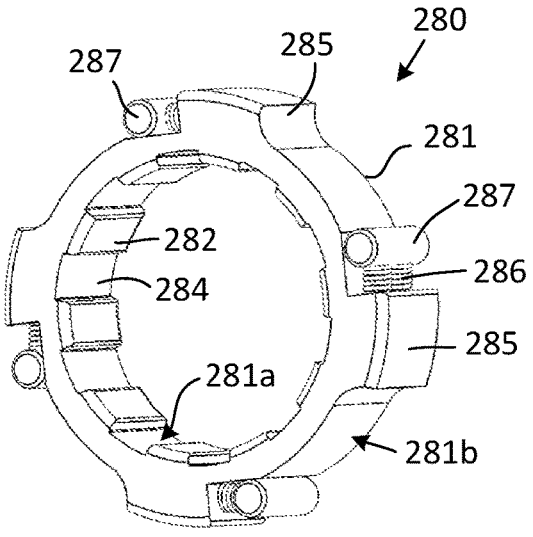
FIG. 15B illustrates a front perspective view of the adapter ring, rollers, and roller springs shown in FIG. 15A.

Referring now to FIGS. 15A and 15B, a rear perspective view and a front perspective view, respectively, illustrate an adapter ring 280 in accordance with an embodiment of the present disclosure. The adapter ring 280 is constructed to permit the muzzle adapter 110 to move axially therethrough. In one embodiment, the adapter ring 280 has a generally circular ring body 281 with an inside surface 281*a* and an outside surface 281*b*. In one embodiment, the inside surface 281*a* of the adapter ring 280 defines ring ridges 282 and ring valleys 284 corresponding to respective valleys 134 and ridges 133 on the muzzle adapter 110. For example, ridges 133 on the muzzle adapter 110 correspond to the ring valleys 284 in size, shape, and location. Similarly, the valleys 134 on the muzzle adapter 110 correspond to ring ridges 282 in size, shape, and location. Accordingly, the muzzle adapter 110 can move through the adapter ring 280 in an axial direction, but is prevented from rotating about the bore axis 102 with respect to the adapter ring 280 due to the interference of the ridges 133 with ring valleys and the valleys 134 with the ring ridges.

In an embodiment, the adapter ring 280 includes one or more spring housings 285 protruding radially from the outside surface 281*b* of the ring body 281. For example, each spring housing 285 is constructed to retain one or more roller springs 286 that extend from the spring housing 285 in a tangential direction along the outside surface 281*b* of the ring body 281. In one embodiment, the outside surface 281*b* includes a flat 283 adjacent each spring housing 285. The flat 283 provides a rolling surface for the roller 287. The springs 286 are configured to bias the roller 287 towards a position of contact with both the outside surface 281*b* of the ring body 281 and the inside surface 203 of the mount proximal end portion 206. In some embodiments, one or more of the spring housings 285 defines a socket 288 extending axially into the spring housing 285. In one embodiment, the socket 288 is a blind bore sized to receive an indexing pin 156 or the like from the proximal wall 144 of the clutch collar 142.

Figure 16A:
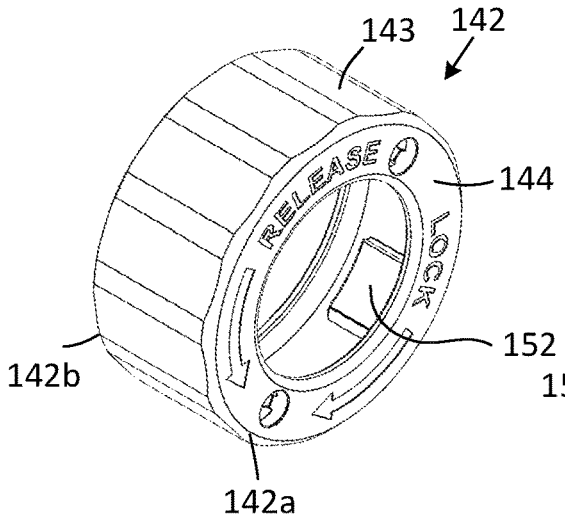
FIG. 16A illustrates a rear perspective view of a clutch collar, in accordance with another embodiment of the present disclosure.
Figure 16B:
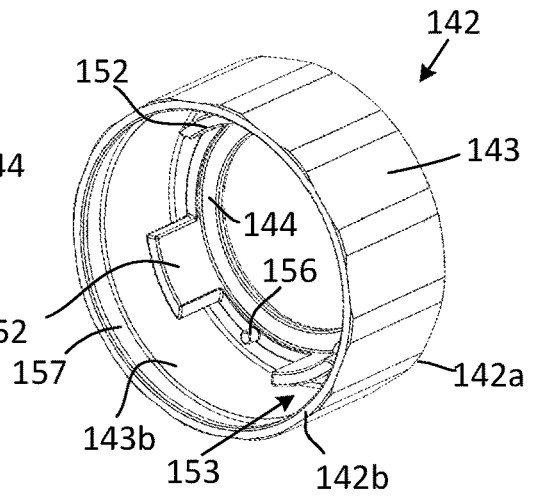
FIG. 16B illustrates a front perspective view of the clutch collar shown in FIG. 16A.
Figure 16C:
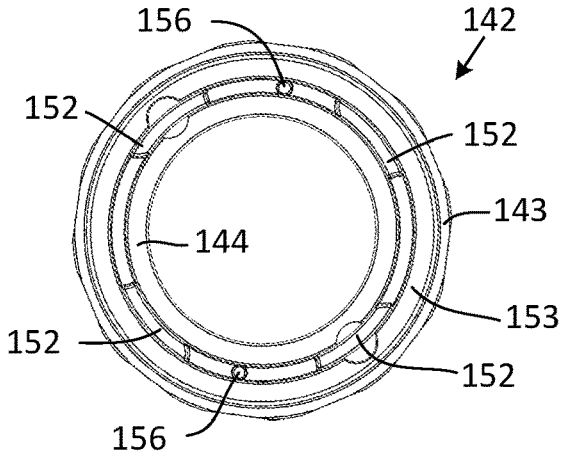
FIG. 16C illustrates a front elevational view of the clutch collar shown in FIG. 16A.

Referring now to FIGS. 16A-16C, a rear perspective view, a front perspective view, and a front elevational view, respectively, illustrate a clutch collar 142 in accordance with another embodiment of the present disclosure. In this embodiment, the proximal wall 144 is connected to the proximal end 142*a* of the collar body 143 and defines a central opening therethrough. One or more protrusions 152 extend axially from the inside face of the proximal wall 144 in locations corresponding to the spring housings 285. For example, each protrusion 152 is positioned to overlap the outside surface 281*b* of the adapter ring 280 between spring housings 285. As the clutch collar 142 rotates towards the unlocked position, each protrusion 152 engages one of the rollers 287. In one embodiment, the protrusions 152 are radially spaced from the inside 143*b* of the collar body 143 to define a radial gap 153 between the protrusion 152 and the collar body 143. For example, the radial gap 153 is sized to receive the mount proximal end portion 206. Optionally, one or more indexing pins 156 extend axially from the proximal wall 144 to be received in a corresponding socket 288 in the spring housing 285 of the adapter ring 280 (shown in FIG. 15A). In some embodiments, the indexing pin(s) 156 also can be used to retain the adapter ring 280 in the locked or unlocked position after it is rotated. In some embodiments, the indexing pin(s) 156 can function as a standoff to prevent the proximal face of the adapter ring 280 from directly engaging the inside face of the proximal wall 144, a situation that may result in frictional engagement that inhibits operation of the clutch assembly 140.

Figure 17A:
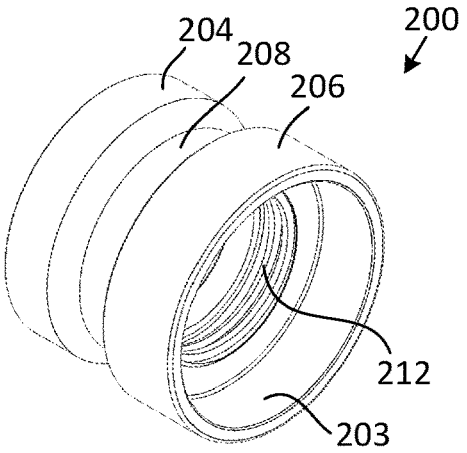
FIG. 17A illustrates a rear perspective view of an attachment mount, in accordance with an embodiment of the present disclosure.
Figure 17B:
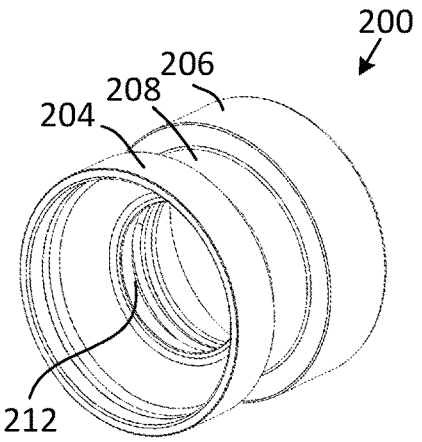
FIG. 17B illustrates a front perspective view of the attachment mount of FIG. 17A.

Referring now to FIGS. 17A and 17B, a rear perspective view and a front perspective view, respectively, illustrate an attachment mount 200 in accordance with another embodiment of the present disclosure. In this embodiment, the attachment mount 200 has a mount distal end portion 204, a mount middle portion 208, and a mount proximal end portion 206. The mount middle portion 208 has a reduced outer diameter compared to the mount proximal end portion 206 and to the mount distal end portion 204. In some embodiments, the mount distal end portion 204 can be configured to releasably attach to a muzzle device, such as threaded engagement to a suppressor or the like. In other embodiments, the mount distal end portion can be permanently secured to or made as an integral part of a muzzle device. In other embodiments, the mount middle portion 208 is configured to attach to the muzzle device 515, such as by threaded engagement with a female thread 212. Numerous variations and embodiments will be apparent in light of the present disclosure.

In some embodiments, the mount proximal end portion 206 has a smooth outer and inner surface that is received in the radial gap 153 of the clutch collar 142. For example, the radial gap 153 in the clutch collar 142 provides sufficient clearance for the mount proximal end portion 206 so that the clutch collar 142 freely rotates with respect to the attachment mount 200. In some embodiments, a split wave spring 228 (shown in FIGS. 13D-13E) can be installed over the mount middle portion 208. The wave spring 228 can be compressed to fit along the inside 143*b* of the clutch collar 142 to retain the clutch collar 142 on the attachment mount 200. For example, the wave spring 228 frictionally engages a groove 157 in the clutch collar 142 and rotates about the mount middle portion 208. In some such embodiments, the split wave spring 228 can be removed from the collar groove 157 and the clutch collar 142 can then be removed in an axial direction to disassemble the mounting assembly 100.

When assembled, the adapter ring 280 can be placed against the inside (distal) face of the proximal wall 144 with the spring housings 285 positioned between adjacent protrusions 152. The adapter ring 280 can be rotated about the bore axis 102 so that the socket(s) 288 align with the indexing pin(s) 156 extending from the proximal wall 144. The attachment mount 200 can then be assembled to the clutch collar 142 by installing the mount proximal end portion 206 in the radial gap 153 between the protrusions 152 and the collar body 143. The wave spring 228 can be compressed circumferentially to be installed in the groove 157 of the clutch collar 142 and against the side of the mount middle portion 208.

Figure 18:
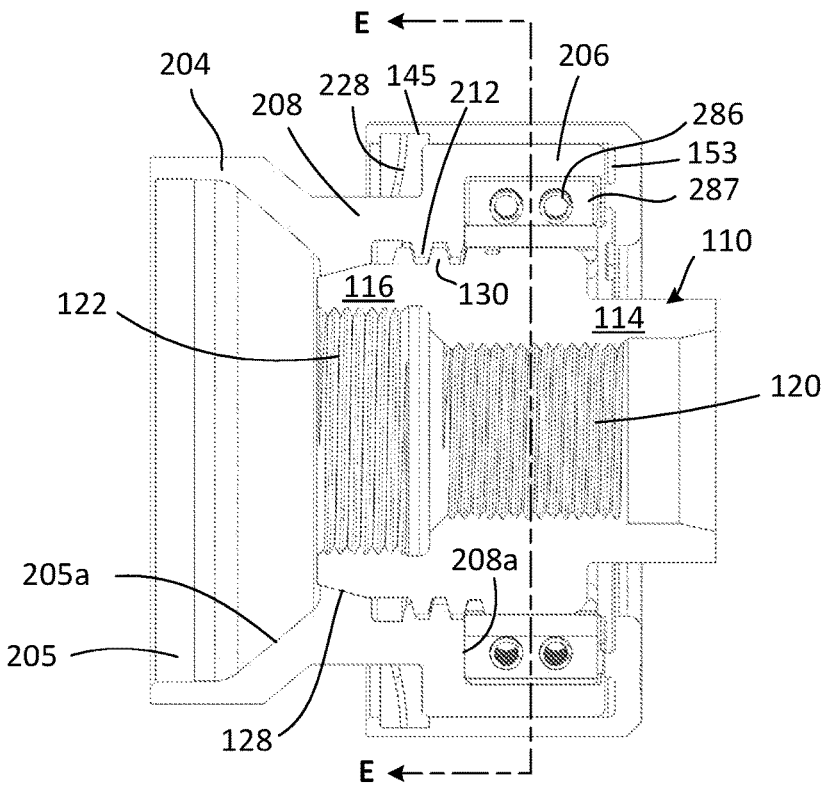
FIG. 18 illustrates a cross-sectional view of a mounting assembly taken along line D-D of FIG. 13B, in accordance with an embodiment of the present disclosure.

Referring now to FIG. 18, a cross-sectional view taken along line D-D of FIG. 13B illustrates the mounting assembly 100 in accordance with an embodiment of the present disclosure. The muzzle adapter 110 is attached to the attachment mount 200 by threaded engagement between the male thread 130 on the muzzle adapter 110 and the female thread 212 along the inside of portions of the mount middle portion 208 and mount proximal end portion 206. The taper 128 on the distal end portion 116 of the muzzle adapter 110 engages corresponding, matching taper on the inside of the mount middle portion 208. In one embodiment, the proximal end portion 114 of the muzzle adapter 110 is configured with a female thread 120 for threaded attachment to the threaded end portion 510 of a barrel 505 (shown in FIG. 1C). The adapter ring 280 is installed over the muzzle adapter 110 and is received in the mount proximal end portion 206. As the attachment mount 200 is threaded onto the muzzle adapter 110, the muzzle adapter 110 can move axially with respect to the adapter ring 280 as needed, such as until the taper 128 abuts the corresponding tapered surface of the attachment mount 200, the mount proximal end portion 206 abuts the proximal wall 144 of the clutch collar 142, and/or the proximally facing surface 208*a* of the mount middle portion 208 abuts the adapter ring 280. The mount proximal end portion 206 is received in the radial gap 153 of the clutch collar 142. The wave spring 228 is installed around the mount middle portion 208 and inside the groove 157 of the clutch collar 142, thereby retaining the clutch collar 142 assembled with and rotatable about the attachment mount 200. The mount distal end portion 204 optionally defines a mouth 205 with a mouth taper or wall 205*a*. A muzzle device 515 can be secured to the attachment mount 200 by threaded engagement with female threads (not shown) in the mouth 205, or by installation in the mouth 205 using a slip fit and followed by welding or securing with fasteners, to name a few examples. To remove the attachment mount 200, the clutch collar 142 can be moved to the unlocked or release position to disengage the locking rollers 287, followed by unscrewing the attachment mount 200 from the muzzle adapter 110. The mounting assembly 100 is shown in the unlocked position in FIG. 18 as indicated by a small clearance gap between the roller 287 and the mount proximal end portion 206.

Figure 19A:
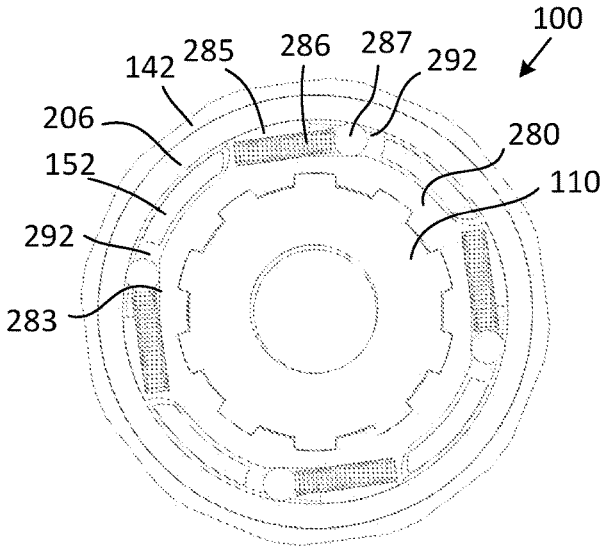
FIG. 19A illustrates a cross-sectional view of a mounting assembly taken along line E-E of FIG. 18 and shows the locking structure in a locked position, in accordance with an embodiment of the present disclosure.
Figure 19B:
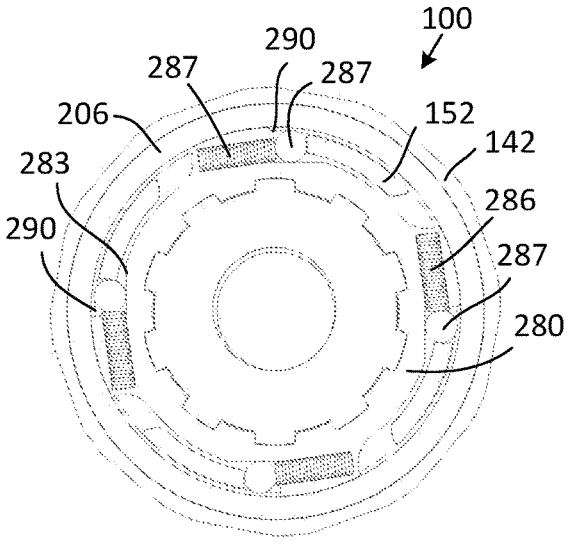
FIG. 19B illustrates a cross-sectional view of a mounting assembly taken along line E-E of FIG. 18 and shows the locking structure in an unlocked position, in accordance with an embodiment of the present disclosure.

Referring now to FIGS. 19A and 19B, cross-sectional views taken along line E-E of FIG. 18 illustrate the locking assembly 100 in the locked position and the unlocked or released position, respectively. FIGS. 19A and 19B both show the mounting assembly 100 as viewed looking distally along the bore axis 102. The mounting assembly 100 is in the locked position in FIG. 19A. Here, the clutch collar 142 has been rotated clockwise, resulting in protrusions 152 disengaging from the rollers 287. In doing so, the roller springs 286 can move the rollers 287 into a pinched or trapped condition between the flat 283 on the outside surface 281*b* of the ring body 281 and the inside surface of the mount proximal end portion 206.

The ring body 281 defines a pinch region 292 and a clearance region 290 between the adapter ring 280 and the mount proximal end portion 206. In the clearance region 290, the radial distance between the flat 283 of the outside surface 281*b* and the mount proximal end portion 206 is greater than the diameter of the rollers 287. In the pinch region 292, the radial distance between the flat 283 section of the outside surface 281*b* of the adapter ring 280 and the mount proximal end portion 206 is less than the diameter of the rollers 287. When the rollers 287 are in the pinch region 292, the rollers 287 engage both the flat 283 on the outside surface 281*b* of the ring body 281 and the inside of the mount proximal end portion, thereby binding the assembly and preventing the attachment mount 200 from rotating (i.e., unscrewing) relative to the adapter ring 280. The roller springs 286 bias the rollers 287 towards the pinch region 292. Accordingly, the mounting assembly 100 resists loosening of the attachment mount 200 due to vibration, recoil forces, or the like. For the same reason, the mounting assembly 100 also prevents attempts to intentionally remove the attachment mount 200 without first moving the clutch assembly 140 to the unlocked position. In some embodiments, components of the mounting assembly 100 must fail or break in order to disconnect the attachment mount 200 when the clutch assembly 140 is in the locked position, as will be appreciated.

FIG. 19B shows the mounting assembly 100 in an unlocked or released position, where the clutch collar 142 has been moved counterclockwise relative to the adapter ring 280 and attachment mount 200 as shown looking distally through the mounting assembly 100 as shown. In doing so, the protrusions 152 on the clutch collar 142 engage the rollers 287 and move them against the force of the roller spring 286 into the clearance region 290. Each roller 287 is maintained in the clearance region 290 as required by the position of the protrusion 152 and the spring housing 285. With the rollers 287 in the clearance region 290, the attachment mount 200 is not restricted from unscrewing from the muzzle adapter 110 because the rollers 287 have sufficient space so as not to bind between the adapter ring 280 and the mount proximal end portion 206. In some embodiments, the clutch collar 142 automatically returns to the locked position when released by the user due to the force of the roller springs 286 pushing the rollers 287 against the protrusions 152 of the clutch collar 142. In such embodiments, for example, the user may be required to hold the clutch collar 142 in the unlocked position while unscrewing the attachment mount 200.

Figure 20:
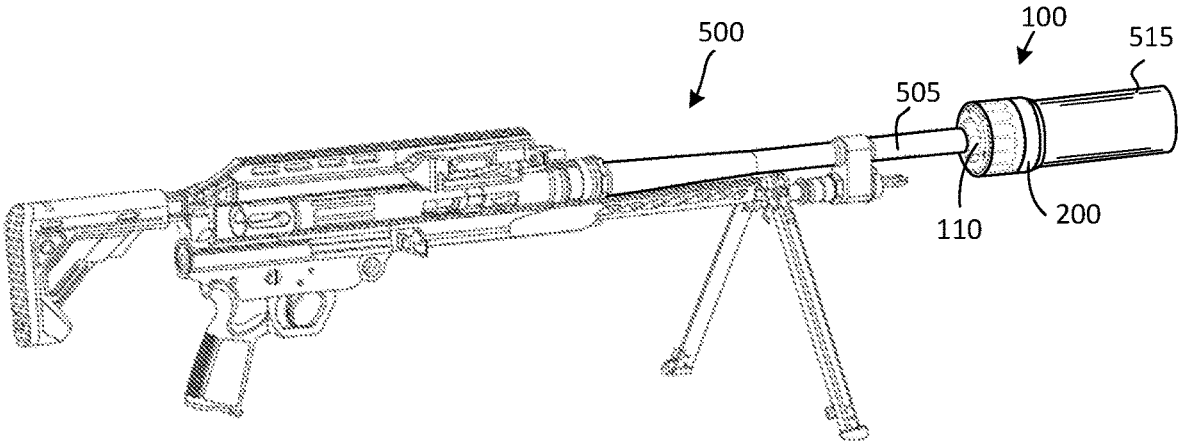
FIG. 20 illustrates a side view of a firearm with a muzzle attachment secured to the mounting assembly and installed on the firearm barrel, in accordance with an embodiment of the present disclosure.
Figure 21:
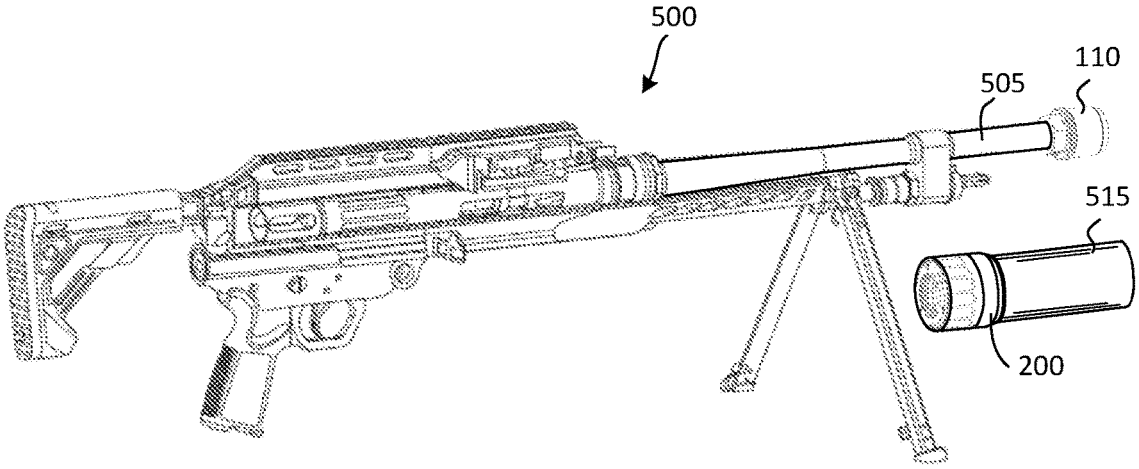
FIG. 21 illustrates a side view of the firearm of FIG. 20 with the attachment mount and muzzle attachment disconnected from the muzzle adapter, which remains installed on the barrel, in accordance with an embodiment of the present disclosure.

FIG. 20 illustrates a side view of a mounting assembly 100 with muzzle attachment 515 installed on the barrel 505 of a host firearm 500 and aligned with the bore axis 102. In this example, the muzzle attachment 515 is secured to the attachment mount 200. The attachment mount 200 is attached to the muzzle adapter 110, which is threaded onto the barrel 505.

FIG. 2I illustrates a side view of the mounting assembly of FIG. 20 shown disconnected from the muzzle adapter 110, which remains secured to the barrel 505 of the host firearm 500. The muzzle attachment 515 remains coupled to the attachment mount 200 and the attachment mount 200 remains coupled to the clutch assembly 140. However, the clutch assembly 140 and attachment mount 200 are separated from the muzzle adapter 110.

Figure 22:
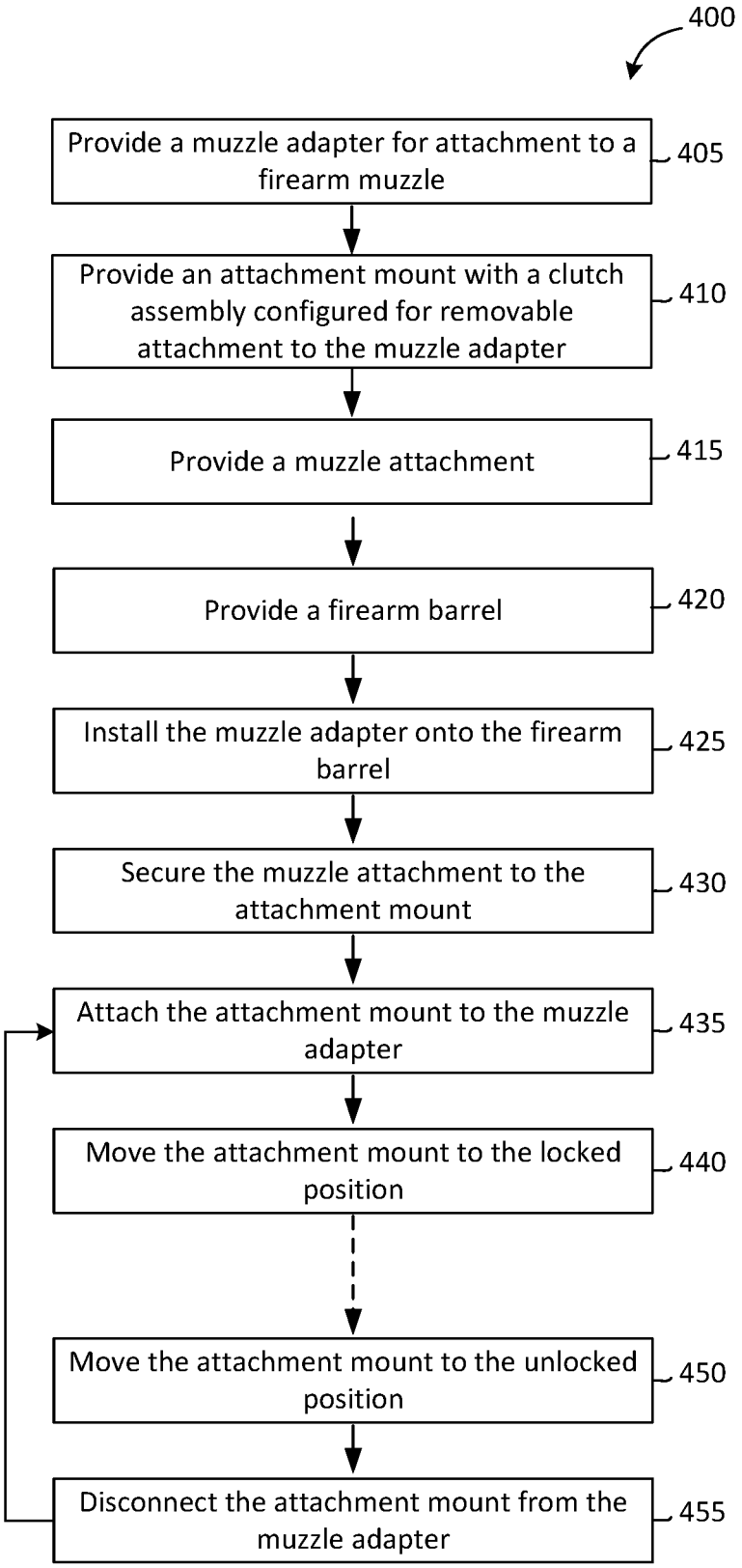
FIG. 22 is a flow chart showing steps in a method of attaching a muzzle attachment to a firearm muzzle and inhibiting inadvertent loosening of the muzzle attachment, in accordance with an embodiment of the present disclosure.

Another aspect of the present disclosure is directed to a method 400 of securing a muzzle attachment to the barrel of a firearm. FIG. 22 illustrates a flowchart showing steps in one embodiment of the method 400. Method 400 includes providing 405 a mounting assembly comprising a muzzle adapter configured to be attached to a firearm barrel. For example, the mounting assembly is any of the embodiments of a mounting assembly as disclosed herein. An attachment mount is provided 410, the attachment mount having a one-way clutch assembly and configured for selective removal of the muzzle attachment from the muzzle adapter. A muzzle attachment is provided 415, such as a suppressor, a muzzle brake, a heat shield, a linear compensator, blank firing adapter, an inert suppressor, or a flash hider. A firearm barrel with a muzzle end portion is provided 420.

The muzzle adapter is installed 425 onto the firearm barrel, such as by screwing the muzzle adapter onto the threaded end of the barrel. Other attachment methods are acceptable as will be appreciated. The muzzle attachment is attached 430 to the attachment mount. For example, the muzzle attachment can be screwed into the distal end portion of the attachment mount. The attachment mount (e.g., with muzzle attachment) is attached 435 to the muzzle adapter. In some embodiments, attaching 435 the attachment mount to the muzzle adapter includes moving the attachment mount to the unlocked position.

After installing the attachment mount on the muzzle adapter with the muzzle attachment secured to the attachment mount, the clutch assembly can be moved 440 to the locked position to engage a locking structure between the muzzle adapter and the attachment mount, thereby preventing or inhibiting a loosening rotation of the muzzle attachment relative to the muzzle adapter. In some embodiments, moving 440 the clutch assembly to the locked position is performed in the same rotational direction as disconnecting the attachment mount from the muzzle adapter. In some embodiments, moving 440 the clutch assembly to the locked position causes the locking structure to engage the body of the muzzle adapter. For example, the locking structure comprises one or more cams, where each cam has an arcuate cam surface constructed to engage the body of the muzzle adapter when the clutch assembly is in the locked position.

In another embodiment, the method 400 also includes 450 moving the clutch assembly to the unlocked position to cause the locking structure to disengage from the body of the muzzle adapter, and disconnecting 455 the muzzle attachment from the muzzle adapter. For example, disconnecting 455 the muzzle attachment from the muzzle adapter is performed without the use of hand tools. With the muzzle attachment secured to the attachment mount, the muzzle attachment can be selectively removed and installed on the firearm as needed. The clutch assembly can be moved to the locked position to prevent inadvertent loosening of the muzzle attachment, and moved to the unlocked position when installing or removing the muzzle attachment from the muzzle adapter, as will be appreciated.

In use, the mounting assembly 100 as described herein, according to some embodiments of the present disclosure, can be attached to the barrel 505 of a host firearm 500 to facilitate installation and removal of muzzle attachments by way of the clutch assembly 140. In some embodiments, the mounting assembly 100 enables secure installation and removal of muzzle attachments without the use of tools. As discussed above, the clutch assembly 140 can utilize a variety of locking structures 160, including cams 162 and rollers 287. The clutch assembly 140 can be selectively moved between a locked position and an unlocked position. When assembled with the clutch assembly 140 in the locked position, the locking structure 160 prevents removal or loosening of the attachment mount 200 from the muzzle adapter 110, whether inadvertently, intentionally, due to vibration or recoil forces, or due to some other cause, until the clutch assembly 140 is moved to the unlocked position.

Some embodiments of the mounting assembly 100 can be installed on the barrel 505 of the host firearm 500 and provide a seal that prevents or reduces infiltration of propellant gases into the mounting assembly 100. The mounting assembly 100 enables the muzzle attachment 515 to be reliably attached to the barrel 505 and properly aligned with the bore axis 102. When moved to the unlocked position, the clutch assembly 140 permits installation or removal of muzzle attachments since the locking structure 160 is disengaged from the muzzle adapter 110. Accordingly, an operator may quickly remove and/or install a muzzle attachment in the field without encountering time-consuming procedures, overtightened fasteners, baked-together interfaces, and other problems of existing attachment mounting assemblies that require the use of tools to remove (or install) the muzzle attachment.

As will be appreciated in light of this disclosure, and in accordance with some embodiments, a mounting assembly 100 as described herein can be utilized with any of a wide range of firearms, including but not limited to, a pistol, a rifle (automatic, semi-automatic, bolt action, etc.), a short-barreled rifle, or a pistol-caliber carbine, to name a few examples. In some embodiments, the mounting assembly 100 can be configured for mounting any of a wide variety of firearm attachments to a barrel 505. For example, some embodiments may be configured for a suppressor, a flash hider, a muzzle brake, a linear compensator, a heat shield, or other accessory as will be appreciated in light of this disclosure. The host firearm 500 can be chambered for any ammunition ranging from .22 LR to 30 mm NATO and everything in between (e.g., .22 LR, .223 Remington, .30 Remington, .380 Auto, .40 S&W, .45 Auto, .50 BMG, 5.56×45 mm NATO, 7.62×39 mm, 7.62×51 mm, 7.62×54 mm, 9×19 mm, 10×25 mm, 30×173 mm NATO, etc.).

Various embodiments of the mounting assembly 100 can be constructed from any suitable material(s), as will be apparent in light of this disclosure. For example, some embodiments of the mounting assembly 100 (or individual components thereof) are constructed from AISI 4140 steel or from chromium- or austenitic nickel-chromium-based alloys, such as 17-4 Stainless Steel or Inconel alloy 625. It may be desirable in some instances for mounting assembly 100 to be constructed of a material that is corrosion resistant, retains strength over a large temperature range (e.g., in the range of about −50° F. to 1200° F.), and/or resistant to deformation and/or fracture at high pressures (e.g., 600-650 psi throughout and over 1000 psi in localized areas). In a more general sense, the mounting assembly 100 can be constructed from any suitable material which is compliant, for example, with United States Defense Standard MIL-W-13855 (Weapons: Small Arms and Aircraft Armament Subsystems, General Specification For). Other suitable materials for the mounting assembly 100 may depend on a given application and will be apparent in light of this disclosure.

Further Example Embodiments

The following examples pertain to further embodiments, from which numerous permutations and configurations will be apparent.

Example 1 is a mounting assembly for firearm muzzle devices, the mounting assembly comprising a muzzle adapter with an adapter body configured to be attached to a firearm barrel, the adapter body having a cylindrical outer surface; an attachment mount having a mount proximal end portion and a mount distal end portion, the attachment mount configured to releasably attach to the adapter body when the muzzle adapter is received in the mount proximal end portion, and configured to be secured to a firearm muzzle device received in the mount distal end portion; and a clutch assembly on the attachment mount, the clutch assembly operable between a locked position and an unlocked position, wherein in the locked position, the clutch assembly engages the muzzle adapter and the attachment mount to inhibit loosening rotation of the attachment mount relative to the muzzle adapter, and wherein in the unlocked position, the clutch assembly disengages from the muzzle adapter to permit loosening rotation of the attachment mount relative to the muzzle adapter.

Example 2 includes the subject matter of Example 1, wherein the clutch assembly comprises a clutch collar rotatable about the attachment mount between the locked position and the unlocked position; and a locking structure configured to selectively engage or disengage the cylindrical outer surface of the muzzle adapter based on the clutch collar being in the locked position or the unlocked position, respectively.

Example 3 includes the subject matter of Example 2, wherein, when the clutch collar is in the locked position, the locking structure engages the cylindrical outer surface of the muzzle adapter, thereby inhibiting loosening rotation of the attachment mount, and when the clutch collar is in the unlocked position, the locking structure disengages from the cylindrical outer surface of the muzzle adapter, thereby permitting loosening rotation of the attachment mount.

Example 4 includes the subject matter of Example 3, wherein the locking structure comprises a cam with an arcuate cam surface, the cam being pivotable about a cam axis due to rotation of the clutch collar; and a cam spring on the attachment mount and engaging the cam; and wherein rotating the clutch collar toward the locked position allows the cam spring to pivot the cam about the cam axis so that the arcuate cam surface engages the outer surface of the muzzle adapter, and wherein rotating the clutch collar toward the unlocked position pivots the cam so that the arcuate cam surface disengages from the outer surface of the muzzle adapter.

Example 5 includes the subject matter of any of Examples 2-4 and further comprises a locking nut attached to the mount proximal end portion of the attachment mount, the locking nut constructed to retain the clutch collar assembled on the attachment mount.

Example 6 includes the subject matter of Example 5, wherein the locking nut threadably engages a thread on the mount proximal end portion.

Example 7 includes the subject matter of Examples 5 or 6, wherein the locking nut comprises an annular body with a distal body portion, a proximal body portion, a radially outer portion, and a radially inward surface defining a female thread, the annular body defining a fastener opening axially therethrough; a resilient tab defined in the distal body portion and axially aligned with the fastener opening, the resilient tab having a first tab end portion connected to the radially outer portion of the annular body and extending unattached radially inward to a second tab end axially aligned with the radially inward surface, wherein a portion of the female thread extends along the second tab end; and a fastener configured to be advanced through the fastener opening; wherein advancing the fastener through the fastener opening causes the fastener to engage the resilient tab and axially deflect the resilient tab, thereby misaligning the portion of the female thread on the distal tab end with the female thread along the radially inward surface of the annular body.

Example 8 includes the subject matter of Example 1, wherein when in the locked position the clutch assembly is a one-way clutch assembly comprising a clutch collar rotatable about the attachment mount and operable to move a lock between a first position corresponding to the locked position, and a second position corresponding to the unlocked position, wherein the lock comprises (i) one or more cams, or (ii) one or more rollers.

Example 9 includes the subject matter of Example 1, wherein the clutch assembly comprises one or more cams, each of the one or more cams mounted in a cam opening in the mount body and positioned to engage the cylindrical outer surface of the adapter body when the clutch assembly is in the locked position and to disengage from the cylindrical outer surface when the clutch assembly is in the unlocked position; a cam spring biasing each of the one or more cams toward the locked position; and a clutch collar overlapping and rotatable about the attachment mount in a first direction to move the clutch assembly to the locked position, and rotatable about the attachment mount in a second direction to move the clutch assembly to the unlocked position.

Example 10 includes the subject matter of Example 9, wherein the cam spring extends along a circumference of the attachment mount and in contact with each of the one or more cams.

Example 11 includes the subject matter of Example 9, wherein the cam spring is a torsion spring having a first leg engaging the mount body and a second leg engaging one of the one or more cams.

Example 12 includes the subject matter of any of Examples 9-11, wherein moving the clutch assembly to the unlocked position further tensions the cam spring.

Example 13 includes the subject matter of any of Examples 9-12, wherein each of the one or more cams is positioned to engage a cylindrical outer surface of the adapter body when the clutch assembly is in the locked position, and each of the one or more cams is positioned to be disengaged from the adapter body when the clutch assembly is in the unlocked position.

Example 14 includes the subject matter of Example 13, wherein each of the one or more cams comprises a cam body with a pin opening therethrough, the pin opening defining a pivot axis for the cam; an arcuate cam surface on the cam body that is eccentric about the pin opening; and a lever arm extending radially outward from the cam body in a first direction; wherein the cam spring applies the spring force to the cam.

Example 15 includes the subject matter of Example 14, wherein each of the one or more cams further comprises a second arm extending radially outward from the cam body in a second direction, the second direction rotated about the pin opening from 20 to 90 degrees with respect to a first direction of the lever arm.

Example 16 includes the subject matter of Examples 14 or 15, wherein an inside of the clutch collar engages the lever arm to pivot the cam when moving the clutch assembly to the unlocked position.

Example 17 includes the subject matter of any of Examples 14-16, wherein an end of the lever arm abuts the inside of the clutch collar when the clutch assembly is in the unlocked position, thereby preventing the cam from pivoting to the locked position.

Example 18 includes the subject matter of any of Examples 1-17, wherein the cylindrical outer surface of the adapter body defines a region of reduced diameter, wherein each of the one or more cams engages the region of reduced diameter when the mounting assembly is in the locked position.

Example 19 includes the subject matter of Example 18, wherein the region of reduced diameter is positioned axially between a proximal portion and a distal portion of the cylindrical outer surface.

Example 20 includes the subject matter of Example 19, wherein the region of reduced diameter has a diameter that is at least 0.0035" smaller than a diameter of the distal portion of the cylindrical outer surface.

Example 21 includes the subject matter of Example 1, wherein the clutch assembly comprises an adapter ring disposed in the mount proximal end portion, the adapter ring having an inside surface constructed to receive the muzzle adapter therein and having one or more structures that prevents rotation of the adapter ring relative to the muzzle adapter, and having an outside surface spaced from an inside surface of the mount proximal end portion by a radial gap; one or more of rollers disposed in the radial gap between the outside surface of the adapter ring and an inside surface of the mount proximal end portion; and a clutch collar installed on the attachment mount with the mount proximal end portion received between clutch collar and the adapter ring, the clutch collar rotatable about the attachment mount; wherein rotating the clutch collar to a first position corresponding to the locked position of the clutch assembly allows the one or more rollers to a pinch region between the adapter ring and the attachment mount, thereby causing the one or more rollers to become trapped and preventing loosening rotation of the adapter ring relative to the attachment mount; and wherein rotating the clutch collar to a second position corresponding to the unlocked position of the clutch assembly moves the one or more rollers to a clearance region between the adapter ring and the attachment mount.

Example 22 includes the subject matter of Example 21, wherein the muzzle adapter defines one or more ridges protruding from an outside surface and extending axially along the adapter body; wherein the adapter ring defines one or more valleys in the inside surface, the one or more valleys complementary to the one or more ridges; and wherein the muzzle adapter is slidingly received in the adapter ring with the one or more ridges in the one or more valleys.

Example 23 includes the subject matter of Example 22 and further comprises one or more spring housings extending radially outward from the outside surface of the adapter ring; and a roller spring retained by each of the one or more spring housings, the roller spring extending between the spring housing and one roller of the one or more rollers to bias the one roller away from the spring housing along the outside surface of the adapter ring.

Example 24 includes the subject matter of Example 23 and further comprises a proximal wall with an annular shape, the proximal wall attached to a proximal end portion of the clutch collar and extending radially inward; and a protrusion extending axially from a proximal wall and received in the radial gap between the outside surface of the adapter ring and the inside surface of the mount proximal end portion; wherein, when moving the clutch collar to the first position, the protrusion disengages from the one roller, thereby allowing the roller spring to extend to a lower energy state while moving the one roller to the pinch region between the adapter ring and the attachment mount; and wherein, when moving the clutch collar to the second position, the protrusion engages the one roller and compresses the roller spring, thereby maintaining the roller in the clearance region between the adapter ring and the attachment mount.

Example 25 is a mounting assembly for firearm muzzle devices, the mounting assembly comprising a muzzle adapter with an adapter body configured to be installed on a firearm barrel; an attachment mount having a generally cylindrical body with a through-opening defined therethrough, a mount proximal end portion, and a mount distal end portion, wherein the attachment mount is configured to secure a firearm muzzle device to the mount distal end portion and to removably attach to the muzzle adapter received in the mount proximal end portion; a one-way clutch assembly on the attachment mount and including (i) a clutch collar rotatable about the attachment mount between a locked position and an unlocked position, (ii) one or more cams, each of the one or more cams retained in a cam opening defined in the body of the attachment mount and pivotable between a first cam position and a second cam position, and (iii) a cam spring extending along a circumference of the body of the attachment mount and in contact with each of the one or more cams, wherein moving the clutch collar to the locked position allows the one or more cams to move to the first cam position, and moving the clutch collar to the unlocked position moves the one or more cams to the second cam position, and wherein when the muzzle adapter is installed in the attachment mount and the clutch collar is moved to the locked position, the one or more cams engage the adapter body to prevent loosening rotation of the muzzle adapter with respect to the attachment mount.

Example 26 includes the subject matter of Example 25, wherein each of the one or more cams has an arcuate cam surface and in the first cam position the arcuate cam surface is positioned radially inward for engagement with the adapter body, and in the second cam position, the arcuate cam surface is positioned radially outward relative to the first cam position, thereby being positioned to provide clearance between the arcuate cam surface and the adapter body.

Example 27 includes the subject matter of Example 25, wherein each of the one or more cams comprises a cam body with a pin opening therethrough and defining a pivot axis; an arcuate cam surface on the cam body that is eccentric about the pin opening, wherein the cam pivots about the pin opening; a lever arm extending radially outward from the cam body in a first direction; and a second arm extending radially outward from the cam body in a second direction, the second direction rotated about the pin opening from 20 to 90 degrees with respect to the first direction; wherein the cam spring applies a spring force to the second arm, thereby biasing the cam towards the first cam position.

Example 28 includes the subject matter of Example 27, wherein the lever arm and the second arm are positioned on an opposite side of the cam body from the arcuate cam surface.

Example 29 includes the subject matter of Example 27, wherein the clutch collar engages the lever arm when moving from the locked position to the unlocked position, thereby pivoting the cam to the second position.

Example 30 includes the subject matter of Example 29, wherein an end of the lever arm contacts an inside surface of the clutch collar when the one-way clutch assembly is in the unlocked position, thereby obstructing the cam from pivoting from the second position to the first position.

Example 31 is a mounting assembly for firearm muzzle devices, the mounting assembly comprising an attachment mount having a mount body with a generally cylindrical shape extending along a bore axis, the mount body including a mount proximal end portion and a mount distal end portion, wherein the attachment mount is configured to releasably attach to a muzzle adapter received in the mount proximal end portion and having a cylindrical adapter body portion with a body radius, and wherein the attachment mount is configured to be secured to a firearm muzzle device received in the mount distal end portion; and a clutch assembly on the attachment mount and including (i) a clutch collar overlapping the body of the attachment mount and rotatable about the body between a locked position and an unlocked position, and (ii) one or more cams, each cam of the one or more cams pivotably retained in a cam opening in the body of the attachment mount and each cam having a cam body with an arcuate cam surface, wherein, when the clutch collar is moved to the locked position, the one or more cams pivot to a first position with the cam surface extending radially inward to a radius equal to or less than the body radius, and when the clutch collar is moved to the unlocked position, the one or more cams pivot to a second position with the cam surface extends radially inward to a radius greater than the body radius.

Example 32 includes the subject matter of Example 31 and further comprises a cam spring on the attachment mount and in contact with each of the one or more cams, the cam spring applying a spring force to bias the one or more cams towards the first cam position.

Example 33 includes the subject matter of Examples 31 or 32 and further comprises the muzzle adapter, wherein the muzzle adapter is configured to be secured to a firearm barrel and has the cylindrical adapter body portion with the body radius.

Example 34 includes the subject matter of Example 33, wherein the muzzle adapter defines a threaded portion to threadably engage the attachment mount.

Example 35 is a mounting assembly for firearm muzzle devices, the mounting assembly comprising an attachment mount having a generally cylindrical body with a through-opening defined therethrough, a mount proximal end portion, and a mount distal end portion, wherein the attachment mount is configured to secure a firearm muzzle device to the mount distal end portion and to releasably attach the mount proximal end portion to a muzzle adapter; and a clutch assembly operable with the attachment mount and including (i) a clutch collar rotatable about the attachment mount between a locked position and an unlocked position, (ii) one or more cams, each of the one or more cams retained in a cam opening defined in the body of the attachment mount and pivotable between a first cam position and a second cam position in response to the clutch collar rotating between the locked position and the unlocked position, respectively, and (iii) a cam spring on the attachment mount and in contact with each of the one or more cams.

Example 36 includes the subject matter of Example 35 and further comprises the muzzle adapter, wherein the muzzle adapter is configured to be secured to a firearm barrel, the muzzle adapter having an adapter body with a threaded portion to threadably engage the attachment mount and a cylindrical sleeve portion extending distally from the threaded portion; and wherein when the muzzle adapter is screwed into the attachment mount and the clutch collar is moved to the locked position, the one or more cams engage the cylindrical sleeve portion to prevent loosening rotation of the attachment mount with respect to the muzzle adapter.

Example 37 includes the subject matter of any of Examples 1-36 and further comprises the firearm muzzle device, the firearm muzzle device selected from a suppressor, a muzzle brake, a flash hider, linear compensator, a blank firing adapter, an inert suppressor, and a heat shield.

Example 38 includes the subject matter of Example 37 and further comprises the firearm barrel, wherein the muzzle adapter is secured to a muzzle end of the firearm barrel.

Example 39 includes the subject matter of Example 38, wherein the attachment mount is installed on the muzzle adapter.

Example 40 includes the subject matter of any of Examples 1-39, wherein the muzzle adapter is configured as a flash hider or muzzle brake.

Example 41 is a locking nut comprising an annular body with a distal body portion, a proximal body portion, a radially outer portion, and a radially inward surface defining a female thread, the annular body defining a fastener opening axially therethrough; a resilient tab defined in the distal body portion and axially aligned with the fastener opening, the resilient tab having a first tab end portion connected to the radially outer portion of the annular body and extending unattached radially inward to a second tab end axially aligned with the radially inward surface, wherein a portion of the female thread extends along the second tab end; and a fastener configured to be advanced through the fastener opening; wherein advancing the fastener through the fastener opening causes the fastener to engage the resilient tab and axially deflect the resilient tab, thereby misaligning the portion of the female thread on the distal tab end with the female thread along the radially inward surface of the annular body.

Example 42 includes the subject matter of Example 41, wherein the fastener opening is threaded.

Example 43 includes the subject matter of Example 41 or 42, wherein the resilient tab is a first tab of a plurality of resilient tabs distributed about the distal body portion.

Example 44 is a method of securing a muzzle attachment to the barrel of a firearm, the method comprising providing a mounting assembly comprising a muzzle adapter configured to be attached to a firearm barrel; providing a muzzle device secured to an attachment mount, wherein the attachment mount includes a one-way clutch assembly configured for selective installation onto and removal of the attachment mount from muzzle adapter; providing a firearm barrel with a muzzle end portion; installing the muzzle adapter onto the firearm barrel; attaching the attachment mount to the muzzle adapter; and moving the clutch assembly to the locked position, thereby engaging a locking structure between the muzzle adapter and the attachment mount to inhibit loosening rotation of the attachment mount relative to the muzzle adapter.

Example 45 includes the subject matter of Example 44, wherein moving the clutch assembly to the locked position proceeds in the same rotational direction as the loosening rotation of the attachment mount from the muzzle adapter.

Example 46 includes the subject matter of Example 44 and further comprises providing the muzzle device and securing the muzzle device to the attachment mount.

Example 47 includes the subject matter of Example 46, wherein the muzzle device is a suppressor, a muzzle brake, a heat shield, an inert suppressor, a blank firing adapter, a linear compensator, or a flash hider.

Example 48 includes the subject matter of Example 47, wherein the muzzle device is an integral part of the mounting assembly.

Example 49 includes the subject matter of Example 44, wherein moving the clutch assembly to the locked position causes the locking structure to engage a body of the muzzle adapter.

Example 50 includes the subject matter of Example 44, wherein the locking structure comprises one or more cams, each cam of the one or more cams having an arcuate cam surface constructed to engage the body of the muzzle adapter when the clutch assembly is in the locked position.

Example 51 includes the subject matter of Example 44 and further comprises moving the clutch assembly to the unlocked position, thereby causing the locking structure to disengage from the body of the muzzle adapter; and disconnecting the muzzle device from the muzzle adapter.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A mounting assembly for firearm muzzle devices, the mounting assembly comprising:

a muzzle adapter with an adapter body configured to be attached to a firearm barrel, the adapter body having a cylindrical sleeve portion;

an attachment mount having a mount proximal end portion and a mount distal end portion, the attachment mount configured to releasably attach to the adapter body when the muzzle adapter is received in the mount proximal end portion, and configured to be secured to a firearm muzzle device received in the mount distal end portion; and a clutch assembly on the attachment mount, the clutch assembly operable between a locked position and an unlocked position, wherein in the locked position, the clutch assembly engages the muzzle adapter and the attachment mount to inhibit loosening rotation of the attachment mount relative to the muzzle adapter, and wherein in the unlocked position, the clutch assembly disengages from the muzzle adapter to permit loosening rotation of the attachment mount relative to the muzzle adapter.

2. The mounting assembly of claim 1, wherein the clutch assembly comprises:

a clutch collar rotatable about the attachment mount between the locked position and the unlocked position; and a locking structure configured to selectively engage or disengage the cylindrical sleeve portion of the muzzle adapter based on the clutch collar being in the locked position or the unlocked position, respectively.

3. The mounting assembly of claim 2, wherein, when the clutch collar is in the locked position, the locking structure engages the cylindrical sleeve portion of the muzzle adapter, thereby inhibiting loosening rotation of the attachment mount, and when the clutch collar is in the unlocked position, the locking structure disengages from the cylindrical sleeve portion of the muzzle adapter, thereby permitting loosening rotation of the attachment mount.

4. The mounting assembly of claim 3, wherein the locking structure comprises:

a cam with an arcuate cam surface, the cam being pivotable about a cam axis due to rotation of the clutch collar; and a cam spring on the attachment mount and engaging the cam;

wherein rotating the clutch collar toward the locked position allows the cam spring to pivot the cam about the cam axis so that the arcuate cam surface engages the sleeve portion of the muzzle adapter, and wherein rotating the clutch collar toward the unlocked position pivots the cam so that the arcuate cam surface disengages from the sleeve portion of the muzzle adapter.

5. The mounting assembly of claim 2 further comprising a locking nut attached to the mount proximal end portion of the attachment mount, the locking nut constructed to retain the clutch collar assembled on the attachment mount.

6. The mounting assembly of claim 5, wherein the locking nut threadably engages a thread on the mount proximal end portion.

7. The mounting assembly of claim 5, wherein the locking nut comprises:

an annular body with a distal body portion, a proximal body portion, a radially outer portion, and a radially inward surface defining a female thread, the annular body defining a fastener opening axially therethrough;

a resilient tab defined in the distal body portion and axially aligned with the fastener opening, the resilient tab having a first tab end portion connected to the radially outer portion of the annular body and extending unattached radially inward to a second tab end axially aligned with the radially inward surface, wherein a portion of the female thread extends along the second tab end; and a fastener configured to be advanced through the fastener opening;

wherein advancing the fastener through the fastener opening causes the fastener to engage the resilient tab and axially deflect the resilient tab, thereby misaligning the portion of the female thread on the distal tab end with the female thread along the radially inward surface of the annular body.

8. The mounting assembly of claim 1, wherein the clutch assembly, when in the locked position, is a one-way clutch assembly comprising:

a clutch collar rotatable about the attachment mount and operable to move a lock between a first position corresponding to the locked position, and a second position corresponding to the unlocked position, wherein the lock comprises (i) one or more cams, or (ii) one or more rollers.

9. The mounting assembly of claim 1, wherein the clutch assembly comprises:

one or more cams, each of the one or more cams mounted in a cam opening in the mount body and positioned to engage the cylindrical sleeve portion of the adapter body when the clutch assembly is in the locked position and to disengage from the cylindrical sleeve portion when the clutch assembly is in the unlocked position;

a cam spring biasing each of the one or more cams toward the locked position; and a clutch collar overlapping and rotatable about the attachment mount in a first direction to move the clutch assembly to the locked position, and rotatable about the attachment mount in a second direction to move the clutch assembly to the unlocked position.

10. The mounting assembly of claim 9, wherein the cam spring extends along a circumference of the attachment mount and in contact with each of the one or more cams.

11. The mounting assembly of claim 9, wherein the cam spring is a torsion spring with a first leg engaging the mount body and a second leg engaging one of the one or more cams.

12. The mounting assembly of claim 9, wherein moving the clutch assembly to the unlocked position further tensions the cam spring.

13. The mounting assembly of claim 9, wherein each of the one or more cams is positioned to engage a cylindrical outer surface of the adapter body when the clutch assembly is in the locked position, and each of the one or more cams is positioned to be disengaged from the adapter body when the clutch assembly is in the unlocked position.

14. The mounting assembly of claim 13, wherein each of the one or more cams comprises:

a cam body with a pin opening therethrough, the pin opening defining a pivot axis for the cam;

an arcuate cam surface on the cam body that is eccentric about the pin opening; and a lever arm extending radially outward from the cam body in a first direction;

wherein the cam spring applies the spring force to the cam.

15. The mounting assembly of claim 14, wherein each of the one or more cams further comprises a second arm extending radially outward from the cam body in a second direction, the second direction rotated about the pin opening from 0 to 90 degrees with respect to a first direction of the lever arm.

16. The mounting assembly of claim 14, wherein an inside of the clutch collar engages the lever arm to pivot the cam when moving the clutch assembly to the unlocked position.

17. The mounting assembly of claim 14, wherein an end of the lever arm abuts the inside of the clutch collar when the clutch assembly is in the unlocked position, thereby preventing the cam from pivoting to the locked position.

18. The mounting assembly of claim 9, wherein the cylindrical sleeve portion of the adapter body defines a region of reduced diameter, wherein each of the one or more cams engages the region of reduced diameter when the mounting assembly is in the locked position.

19. The mounting assembly of claim 1, wherein the clutch assembly comprises:

an adapter ring disposed in the mount proximal end portion, the adapter ring having an inside surface constructed to receive the muzzle adapter therein and having one or more structures that prevents rotation of the adapter ring relative to the muzzle adapter, and having an outside surface spaced from an inside surface of the mount proximal end portion by a radial gap;

one or more of rollers disposed in the radial gap between the outside surface of the adapter ring and an inside surface of the mount proximal end portion; and a clutch collar installed on the attachment mount with the mount proximal end portion received between clutch collar and the adapter ring, the clutch collar rotatable about the attachment mount;

wherein rotating the clutch collar to a first position corresponding to the locked position of the clutch assembly allows the one or more rollers to a pinch region between the adapter ring and the attachment mount, thereby causing the one or more rollers to become trapped and preventing loosening rotation of the adapter ring relative to the attachment mount; and wherein rotating the clutch collar to a second position corresponding to the unlocked position of the clutch assembly moves the one or more rollers to a clearance region between the adapter ring and the attachment mount.

20. The mounting assembly of claim 19, wherein the muzzle adapter defines one or more ridges protruding from an outside surface and extending axially along the adapter body;

wherein the adapter ring defines one or more valleys in the inside surface, the one or more valleys complementary to the one or more ridges; and wherein the muzzle adapter is slidingly received in the adapter ring with the one or more ridges in the one or more valleys.

21. The mounting assembly of claim 20 further comprising:

one or more spring housings extending radially outward from the outside surface of the adapter ring; and a roller spring retained by each of the one or more spring housings, the roller spring extending between the spring housing and one roller of the one or more rollers to bias the one roller away from the spring housing along the outside surface of the adapter ring.

22. The mounting assembly of claim 21 further comprising:

a proximal wall with an annular shape, the proximal wall attached to a proximal end portion of the clutch collar and extending radially inward; and a protrusion extending axially from a proximal wall and received in the radial gap between the outside surface of the adapter ring and the inside surface of the mount proximal end portion;

wherein, when moving the clutch collar to the first position, the protrusion disengages from the one roller, thereby allowing the roller spring to extend to a lower energy state while moving the one roller to the pinch region between the adapter ring and the attachment mount; and wherein, when moving the clutch collar to the second position, the protrusion engages the one roller and compresses the roller spring, thereby maintaining the roller in the clearance region between the adapter ring and the attachment mount.

23. The mounting assembly of claim 1 further comprising the firearm muzzle device, the firearm muzzle device selected from a suppressor, a muzzle brake, a flash hider, a linear compensator, a blank firing adapter, an inert suppressor, and a heat shield.

24. The mounting assembly of claim 23 further comprising the firearm barrel, wherein the muzzle adapter is secured to a muzzle end of the firearm barrel.

25. The mounting assembly of claim 24, wherein the attachment mount is installed on the muzzle adapter.

* * * * *